US005285723A

United States Patent [19]

Ichikawa et al.

[11] Patent Number: 5,285,723

[45] Date of Patent: Feb. 15, 1994

[54] PRINTING APPARATUS FOR WIRE MATERIAL

[75] Inventors: Tadashi Ichikawa; Mitsuo Takahashi, both of Narita, Japan

[73] Assignee: Japan Airlines Co., Ltd., Tokyo, Japan

[21] Appl. No.: 828,812

[22] PCT Filed: May 31, 1991

[86] PCT No.: PCT/JP91/00745

§ 371 Date: Jan. 28, 1992

§ 102(e) Date: Jan. 28, 1992

[87] PCT Pub. No.: WO91/19299

PCT Pub. Date: Dec. 12, 1991

[30] Foreign Application Priority Data

May 31, 1990 [JP] Japan ..... 2-141872

[51] Int. Cl.[5] ..... B41F 17/00

[52] U.S. Cl. ..... 101/35; 101/4

[58] Field of Search ..... 101/35, 4, 37, 43, 44

[56] References Cited

U.S. PATENT DOCUMENTS 4,029,006 6/1977 Mercer ..... 101/35

4,370,542 1/1983 Mills et al. ..... 101/35 X 4,827,841 5/1989 White, Sr. ..... 400/605

5,066,153 11/1991 Stephens ..... 101/226

5,067,399 11/1991 Berry ..... 101/27 X

FOREIGN PATENT DOCUMENTS 194537 9/1986 European Pat. Off. ..... 101/35

57-19908 2/1957 Japan .

61-224219 10/1986 Japan .

*Primary Examiner*—Edgar S. Burr

*Assistant Examiner*—Ren Yan

*Attorney, Agent, or Firm*—Beveridge, DeGrandi, Weilacher & Young

[57] ABSTRACT

A printing apparatus for printing an identification display such as schema numerals, symbols or the like for a wire material on the outer peripheral surface of the wire materials such as an electric wire cord is disclosed. The printing apparatus for the wire material is provided with a selection and drive unit for feeding, respectively, plural kinds of wire materials and selecting a wire material corresponding to a wire material to be printed and with a movable printing unit to be moved to a position corresponding to the wire material fed from the selection and drive unit to perform the printing operation.

19 Claims, 38 Drawing Sheets

1 : FILE 2 : DATA 3 : PRINT 4 : MAINTENANCE 5 : END

FILE

1 : READ
2 : WRITE
3 : FILE CHART
4 : FILE CONVERSION
5 : PRINT
6 : OS SHELL
7 : TO MENU

WIRE STA

DIR**

FILE NUMBER = 12
DISPLAY NUMBER = 12

WIRE

| FILE NAME | | NUMBER | DATA | TIME |
|---|---|---|---|---|
| PLS_CCT | DRH | 1517 | 89-08-11 | 0 : 15 |
| 98PLS-A4 | DRH | 563 | 89-08-07 | 22 : 09 |
| IF_PWRXX | DRH | 1179 | 89-08-04 | 2 : 35 |
| ROB_BLK_ | DRH | 166 | 89-07-30 | 18 : 06 |
| 9810 A4X | DRH | 560 | 89-08-03 | 15 : 29 |
| ROBT | D00 | 14 | 90-04-09 | 11 : 05 |
| ROB | D00 | 4 | 90-04-09 | 11 : 10 |
| 73410891 | D01 | 13 | 90-05-03 | 16 : 21 |
| TC1 | D00 | 303 | 90-04-09 | 14 : 16 |
| 7341089 | D12 | 13 | 90-05-03 | 16 : 22 |
| 16221203 | D02 | 13 | 90-05-03 | 16 : 40 |
| 4261011 | D01 | 7 | 90-05-03 | 16 : 41 |

SELECT BY ARROW AND
RETURN KEY

FILE NAME INPUT

REMAINING CAPACITY 58880

NECESSARY CAPACITY 4500 BYTE

SIFT, SCROLL BY ARROW KEY, INTERRUPT ESC BY KEY

FIG. 29

1 : FILE 2 : DATA 3 : PRINT 4 : MAINTENANCE 5 : END FILE NAME<B:7341089.D12>

WIRE STAMPING

FILE

1 : READ
2 : WRITE
3 : FILE CHART
4 : FILE CONVERSION
5 : PRINT
6 : OS SHELL
7 : END ESC

DATA • FILE READ

FIG. 30

| Signal/Function | Bundle# | Wire# | Type | Length | Frm Conn. | Pin# | To Conn. | Pin# | Wiring Diagram | Final Destination |
|---|---|---|---|---|---|---|---|---|---|---|
| Mag Hdg Sync Input-X | W9121 | RA9101-24R | VC | 8 | DB9074FA | 5A | D9701P | 11 | WD34139222-1 | MHRS thru E3-3/E3-5 |
| Mag Hdg Sync Input-Y | W9121 | RA9102-24B | VC | — | DB9074FA | 5B | D9701P | 12 | WD34139222-1 | MHRS thru E3-3/E3-5 |
| Mag Hdg Sync Input-Z | W9121 | RA9103-24Y | VC | — | DB9074FA | 5C | D9701P | 13 | WD34139222-1 | MHRS thru E3-3/E3-5 |
| Mag Hdg Valid Disc In | W9121 | RA9104-22 | 22 | 8 | DB9074FA | 6C | D9697P | 7 | WD34139222-1 | E1-4 |
| Mag Hdg 26 VAC Ref-H | W9121 | RA9105-22 | 22 | 8 | DB9074FA | 5H | D9701P | 24 | WD34139222-1 | MHRS thru E3-3/E3-5 |
| Mag Hdg 26 VAC Ref-C | W9121 | RA9106-22 | 22 | 4 | DB9074FA | 5J | GDZ045-AC | — | WD34139222-1 | |
| Synth. Voice Output (600 ohms) H | W9121 | RZ9131-22R | VB | 4 | DB9074FA | 3F | TZ207 | G86 | WD34139222-1 | Cockpit Speaker Pin#9 |
| Synth. Voice Output (600 ohms) L | W9121 | RZ9134-22B | VB | — | DB9074FA | 3G | TZ207 | G87 | WD34139222-1 | Cockpit Speaker Pin#10 |
| Synth. Voice Output (600 ohms) H | W9121 | RZ9132-22R | VB | 8 | TZ207 | G86 | D9698P | 9 | WD34139222-1 | Capt. Speaker DB155-9 |
| Synth. Voice Output (600 ohms) L | W9121 | RZ9135-22B | VB | — | TZ207 | G87 | D9698P | 21 | WD34139222-1 | Capt. Speaker DB155-10 |
| R/A #1 ARINC552(A) Input + | W9121 | SA9101-22R | VG | 8 | DB9074FA | 2H | D9697P | 3 | WD34139222-1 | LRRA#1 DB73C-22 |
| R/A #1 ARINC552(A) Input - | W9121 | SA9102-22B | VG | — | DB9074FA | 2J | D9697P | 11 | WD34139222-1 | LRRA#1 DB73C-23 |
| R/A #1 ARINC552(A) Valid | W9121 | SA9103-22 | 22 | 8 | DB9074FA | 2K | D9697P | 12 | WD34139222-1 | LRRA#1 DB73C-12 |
| 115V AC Primery Power - Hot | W9121 | SX9101-22 | 22 | 8 | DB9075DA | 1 | D9698P | 26 | WD34139222-1 | CCB(5A) |
| Transponder Fail Disc #2 Output | W9121 | SX9103-22 | 22 | 8 | DB9075DA | 3B | D9698P | 5 | WD34139222-1 | TTC-920 J1/2-Pin12. |
| Air/Ground Disc Input #2 | W9121 | SX9104-22 | 22 | 8 | DB9075DA | 5J | D9698P | 27 | WD34139222-1 | To A/G RLY thru C/P-15 |
| Standby/On | W9121 | SX9105-22 | 22 | 8 | DB9075DA | 7G | D9698P | 28 | WD34139222-1 | C/P J#-Pin 7 |
| Control Data Input Port B-A | W9121 | SX9106-24R | WG | 8 | DB9075DA | 7E | D9698P | 4 | WD34139222-1 | C/P J#-Pin 22 |
| Control Data Input Port B-B | W9121 | SX9107-24B | WG | — | DB9075DA | 7F | D9698P | 5 | WD34139222-1 | C/P J#-Pin 23 |
| Sync Alt Input #1-Coarse X | W9121 | SX9111-22R | UC | 8 | DB9075DA | 4A | D9697P | 16 | WD34139222-1 | DB163D-70 : DB164D-70 |
| Sync Alt Input #1-Coarse Y | W9121 | SX9112-22B | UC | — | DB9075DA | 4B | D9697P | 28 | WD34139222-1 | DB163D-71 : DB164D-71 |
| Sync Alt Input #1-Coarse Z | W9121 | SX9113-22Y | UC | — | DB9075DA | 4C | D9697P | 29 | WD34139222-1 | DB163D-72 : DB164D-72 |
| Sync Alt Input #1-Fine X | W9121 | SX9114-22R | UC | 8 | DB9075DA | 4F | D9697P | 14 | WD34139222-1 | DB163D-73 : DB164D-73 |
| Sync Alt Input #1-Fine Y | W9121 | SX9115-22B | UC | — | DB9075DA | 4G | D9697P | 26 | WD34139222-1 | DB163D-74 : DB164D-74 |
| Sync Alt Input #1-Fine Z | W9121 | SX9116-22Y | UC | — | DB9075DA | 4H | D9697P | 27 | WD34139222-1 | DB163D-75 : DB164D-75 |
| Sync Alt Input #1-Flag | W9121 | SX9117-22 | 22 | 8 | DB9075DA | 4J | D9697P | 15 | WD34139222-1 | DB163C-50 : DB164C-50 |
| Sync Alt Input #1-Ref (H) | W9121 | SX9118-22 | 22 | 8 | DB9075DA | 4D | D9697P | 5 | WD34139222-1 | DB163B-38 : DB164B-38 |
| Sync Alt Input #1-Ref (C) | W9121 | SX9119-22 | 22 | 4 | DB9075DA | 4E | GDZ041-AC | — | WD34139222-1 | |
| 115V AC Primery Power-Cold | W9121 | SX9131-20 | 20 | 4 | DB9075DA | 7 | GDZ041-AC | — | WD34139222-1 | AC Grd. C/P J#-Pin 4 |

FIG. 31

| Bundle# | Wire# | Length | Wiring Diagram |
|---|---|---|---|
| W9121 | RA9101-24R | 8 | WD34139222-1 |
| W9121 | RA9102-24B | — | WD34139222-1 |
| W9121 | RA9103-24Y | — | WD34139222-1 |
| W9121 | RA9104-22 | 8 | WD34139222-1 |
| W9121 | RA9105-22 | 8 | WD34139222-1 |
| W9121 | RA9106-22 | 4 | WD34139222-1 |
| W9121 | RZ9131-22R | 4 | WD34139222-1 |
| W9121 | RZ9134-2ZB | — | WD34139222-1 |
| W9121 | RZ9132-2ZR | 8 | WD34139222-1 |
| W9121 | RZ9135-22B | — | WD34139222-1 |
| W9121 | SA9101-22R | 8 | WD34139222-1 |
| W9121 | SA9102-22B | — | WD34139222-1 |
| W9121 | SA9103-22 | 8 | WD34139222-1 |
| W9121 | SX9101-22 | 8 | WD34139222-1 |
| W9121 | SX9103-22 | 8 | WD34139222-1 |
| W9121 | SX9104-22 | 8 | WD34139222-1 |
| W9121 | SX9105-22 | 8 | WD34139222-1 |
| W9121 | SX9106-24R | 8 | WD34139222-1 |
| W9121 | SX9107-24B | — | WD34139222-1 |
| W9121 | SX9111-22R | 8 | WD34139222-1 |
| W9121 | SX9112-22B | — | WD34139222-1 |
| W9121 | SX9113-22Y | — | WD34139222-1 |
| W9121 | SX9114-22R | 8 | WD34139222-1 |
| W9121 | SX9115-22B | — | WD34139222-1 |
| W9121 | SX9116-22Y | — | WD34139222-1 |
| W9121 | SX9117-22 | 8 | WD34139222-1 |
| W9121 | SX9118-22 | 8 | WD34139222-1 |
| W9121 | SX9119-22 | 4 | WD34139222-1 |
| W9121 | SX9131-20 | 4 | WD34139222-1 |
| W9121 | SX9132-20 | 4 | WD34139222-1 |
| W9121 | SX9133-20 | 4 | WD34139222-1 |
| W9121 | SX9133-24 | 4 | WD34139222-1 |
| W9121 | SX9135-22 | 4 | WD34139222-1 |
| W9121 | SX9136-24 | 4 | WD34139222-1 |
| W9121 | SX9137-24 | 4 | WD34139222-1 |
| W9121 | SX9138-24 | 4 | WD34139222-1 |
| W9121 | SX9139-24 | 4 | WD34139222-1 |

FIG. 32

| Bundle# | Wire# | Length | Wiring Diagram |
|---|---|---|---|
| W9121 | RA9101-24R | 8 | WD34139222-1 |
| W9121 | RA9102-24B | — | WD34139222-1 |
| W9121 | RA9103-24Y | — | WD34139222-1 |
| W9121 | RA9104-22 | 8 | WD34139222-1 |
| W9121 | RA9105-22 | 8 | WD34139222-1 |
| W9121 | RA9106-22 | 4 | WD34139222-1 |
| W9121 | RZ9131-22R | 4 | WD34139222-1 |
| W9121 | RA9134-22B | — | WD34139222-1 |
| W9121 | RZ9132-22R | 8 | WD34139222-1 |
| W9121 | RZ9135-22B | — | WD34139222-1 |
| W9121 | SA9101-22R | 8 | WD34139222-1 |
| W9121 | SA9102-22B | — | WD34139222-1 |
| W9121 | SA9103-22 | 8 | WD34139222-1 |
| W9121 | SX9101-22 | 8 | WD34139222-1 |
| W9121 | SX9103-22 | 8 | WD34139222-1 |
| W9121 | SX9104-22 | 8 | WD34139222-1 |
| W9121 | SX9105-22 | 8 | WD34139222-1 |
| W9121 | SX9106-24R | 8 | WD34139222-1 |
| W9121 | SX9107-24B | — | WD34139222-1 |
| W9121 | SX9111-22R | 8 | WD34139222-1 |
| W9121 | SX9112-22B | — | WD34139222-1 |
| W9121 | SX9113-22Y | — | WD34139222-1 |
| W9121 | SX9114-22R | 8 | WD34139222-1 |
| W9121 | SX9115-22B | — | WD34139222-1 |
| W9121 | SX9116-22Y | — | WD34139222-1 |
| W9121 | SX9117-22 | 8 | WD34139222-1 |
| W9121 | SX9118-22 | 8 | WD34139222-1 |
| W9121 | SX9119-22 | 4 | WD34139222-1 |
| W9121 | SX9131-20 | 4 | WD34139222-1 |
| W9121 | SX9132-20 | 4 | WD34139222-1 |
| W9121 | SX9133-20 | 4 | WD34139222-1 |
| W9121 | SX9133-24 | 4 | WD34139222-1 |
| W9121 | SX9135-22 | 4 | WD34139222-1 |
| W9121 | SX9136-24 | 4 | WD34139222-1 |
| W9121 | SX9137-24 | 4 | WD34139222-1 |
| W9121 | SX9138-24 | 4 | WD34139222-1 |
| W9121 | SX9139-24 | 4 | WD34139222-1 |
| W9121 | SX9181-RG393 | 5 | WD34139222-1 |
| W9121 | SX9182-RG393 | 5 | WD34139222-1 |
| W9121 | SX9191-BA5903 | 5 | WD34139222-1 |
| W9121 | SX9192-BA5903 | 5 | WD34139222-1 |
| W9121 | SX9193-BA5903 | 5 | WD34139222-1 |
| W9121 | SX9193-BA5903 | 5 | WD34139222-1 |
| W9121 | SX9194-BA5903 | 5 | WD34139222-1 |
| W9121 | SX9301-24 | 4 | WD34139222-1 |
| W9121 | SX9303-24 | 4 | WD34139222-1 |
| W9121 | SX9306-24 | 4 | WD34139222-1 |
| W9121 | SX9307-24 | 4 | WD34139222-1 |
| W9121 | SX9308-24 | 4 | WD34139222-1 |
| W9121 | SX9309-24 | 4 | WD34139222-1 |

FIG. 33

```
1 : FILE   2 : DATA   3 : PRINT   4 : MAINTENANCE   5 : END      FILE NAME <B:7341089. D12>

 DATA                                  WIRE STA
                                                                 WIRE NO.---------THICKNESS-LENGTH-CLASS--
 1 : INPUT                                                       W1234-AB1111-22        22     20     1
 2 : INDEX                  |   FILE NUMBER = 13  |             W1234-AB1112-22        22     20     1
 3 : PRINT                  | DISPLAY NUMBER = 13 |             W1234-AB1113-22        22     20     1
 4 : TO MENU                                                     W1234-AB1114-22        22     20     1
                                                                 W1234-AB1115-22        22     20     1
                                                                 W1234-TR5432-20        22     20     1
                                                                 W1234-TR5433-20        22     20     1
                                                                 W5678-TA8765-24        24     25     2
TENPLATE ---> W5678  LA345  -18   10  2                           W5678-TA8766-24        24     25     2
                                ALL=F10                          W5678-TA8767-24        24     25     2
                                                                 W5678-TA8768-24        24     25     2
 CLASS INPUT : PRESENCE                                          W5678-LA3451-18        18     10     2
                                                                 W5678-LA3452-18        18     10     2
 DATA ADDITION. RET INPUT BY KEY                                   *** -> DATA ADDITION (SELECT ME) ***

 DATA INPUT        LENGTH   CLASSIFICATION
 W5678-LA3453-18     10       2

                                                   ALL DATA DISPLAYED!!
```

FIG. 35

```
WIRE STAMPING-AUTO                                   FILE NAME <B:7341089. D12>

 AUTO                                                          COA NO.
 STOP(ESC)                                                     B-747
 INTERRUPT(F.1)      REMAINING TIME    REQUIRED TIME           COA34-1089 ER-12
                       02 : 07  sec      01 : 30  sec

 EQUIPMENT CONDITION                   WIRE NO. (DURING PRINTING)----- # ------ ft-CLASS
 PRINTING CONDITION    DURING PRINTING W5678-TA8765-24                24     25  2
 (CONDITION OF RESPECTIVE EQUIPMENT)
 INK JET PRINTR : DURING PRINTING
 HEAD TABLE     : 1 (#24)              MASSAGE AREA
 WIRE DRIVE     :    RUN                1__sec 0 =  6
 WIRE SELECT    : 1 (#24)               1__sec   = 17
 TURN TABLE     :    RUN                s__len   = 25
 PAPER PRINTER  :
 GUIDE/WIRE #5  : D/2SJ-24
 GUIDE/WIRE #5  : E/2SJ-22

STOP AFTER PRINTING (CONTINUE)                                  17 : 02 : 07
```

FIG. 36

1 : FILE 2 : DATA 3 : PRINT 4 : MAINTENANCE 5 : END FILE NAME <B:7341089. D12>

PRINTING

1 : AUTO
2 : SEMI AUT
3 : SET UP
4 : WIRE SET
5 : TO MENU

WIRE STAMPING

EXECUTION
INTERRUPTION(ESC)

EQUIPMENT CONDITION

PRINTING CONDITION DURING EMERGENCY STOP (CONDITION OF RESPECTIVE EQUIPMENT)

| | |
|---|---|
| INK JET PRINTR : | JET OFF |
| HEAD TABLE : | POWER OFF |
| WIRE DRIVE : | POWER OFF |
| WIRE SELECT : | AIR S/O |
| TURN TABLE : | POWER OFF |
| PAPER PRINTER : | |
| GUIDE/WIRE #5 : | B/1SJ-20 |
| GUIDE/WIRE #5 : | D/#10 |

EMERGENCY MESSAGE

DURING EMERGENCY STOP (EQUIPMENT FAILURE)!
INK JET PRINTER NI ABNORMAL CONDITION OCCUR
INK JET
CONFIRM CONDITION BY 「STAT」 KEY OF PANEL
RE-PRINTABLE IF RED FAIL IS VANISHED
IF NOT VANISHED ORDER REMEDY
AFTER MSG CONFIRMATION REPRESS ESC KEY

16 : 24 : 45

FIG. 37

```
WIRE STAMPING-AUTO                                  [EMU] FILE NAME <B:7112222. D01>

 AUTO                                                                  COA NO.
 STOP(ESC)                                                             B-747  <B:7112222. $01>
 INTERRUPT(F.1)      REQUIRED TIME      REMAINING TIME                 COA11-2222 ER-01
                       05 : 51  sec       05 : 45  sec
                                                                          <B:7112222. $01>

 EQUIPMENT CONDITION                      WIRE NO. (DURING PRINTING)----- # ------ ft-CLASS
 PRINTING CONDITION  DURING EMERGENCY     W012-2F1018-24                  24      5 SH-01
                     STOP
 (CONDITION OF RESPECTIVE EQUIPMENT)
 INK JET PRINTR :   JET OFF               EMERGENCY MESSAGE
 HEAD TABLE     : POWER OFF               DURING EMERGENCY STOP (EQUIPMENT FAILURE)!
 WIRE DRIVE     : POWER OFF               PULSE BOARD    FAIL
 WIRE SELECT    :   AIR S/O               RE-SETUP EXECUTE CHECKING
 TURN TABLE     : POWER OFF               CUT POWER SOURCE IF NO CONDITION CHANGE
 PAPER PRINTER  :    ON LINE              ORDER REMADY
 GUIDE/WIRE #5  : F/3SJ-20
 GUIDE/WIRE #5  : E/3SJ-24                AFTER MSG CONFIRMATION DEPRESS ESC KEY

                                                                                 22 : 34 : 24
```

FIG. 38

WIRE STAMPING-AUTO

[EMU] FILE NAME <B:7112222. D01>

AUTO
STOP(ESC)
INTERRUPT(F.1)

REQUIRED TIME
07 : 08 sec

REMAINING TIME

COA NO.
B-747 <B:7112222. $01>
COA11-2222 ER-01

<B:7112222. $01>

EQUIPMENT CONDITION

PRINTING CONDITION DURING EMERGENCY STOP (CONDITION OF RESPECTIVE EQUIPMENT)

| | |
|---|---|
| INK JET PRINTR : | JET OFF |
| HEAD TABLE : | POWER OFF |
| WIRE DRIVE : | POWER OFF |
| WIRE SELECT : | AIR S/O |
| TURN TABLE : | POWER OFF |
| PAPER PRINTER : | ON LINE |
| GUIDE/WIRE #5 : | F/3SJ-20 |
| GUIDE/WIRE #5 : | E/3SJ-24 |

WIRE NO. (DURING PRINTING)----- # ------ ft-CLASS
W012-2F1015-24 24 2 SH-01

EMERGENCY MESSAGE

DURING EMERGENCY STOP (EQUIPMENT FAILURE)!
SOME ABNORMAL CONDITION OCCURS HEAD TABLE
RE-SETUP AND EXECUTE RE-CHECKING
CUT POWER SOURCE IF NO CONDITION CHANGE
ORDER REMADY

AFTER MSG CONFIRMATION DEPRESS ESC KEY

22 : 15 : 03

FIG. 39

WIRE STAMPING-AUTO [EMU] FILE NAME <B:7112222. D01>

AUTO
STOP(ESC)
INTERRUPT(F.1)

REQUIRED TIME
07 : 08 sec

REMAINING TIME

COA NO.
B-747 <B:7112222. $01>
COA11-2222 ER-01

<B:7112222. $01>

EQUIPMENT CONDITION
PRINTING CONDITION DURING EMERGENCY STOP
(CONDITION OF RESPECTIUE EQUIPMENT)
INK JET PRINTR : JET OFF
HEAD TABLE : POWER OFF
WIRE DRIVE : POWER OFF
WIRE SELECT : AIR S/O
TURN TABLE : POWER OFF
PAPER PRINTER : ON LINE
GUIDE/WIRE #5 : F/3SJ-20
GUIDE/WIRE #5 : E/3SJ-24

WIRE NO. (DURING PRINTING)----- # ------ ft-CLASS
W012-2F1018-24 24 2 SH-01

EMERGENCY MESSAGE
DURING EMERGENCY STOP (EQUIPMENT FAILURE)!
STOP MOTOR CONTROLLER IS HEATED
DEPRESS EMERGENCY STOP SW AND OPEN CABINET AND DOOR
COOL SEVERAL TIMES AND AFTER SET-UP AND EXECUTE RE-CHEKING
CUT POWER SOURCE IF NO CONDITION CHANGE
ORDER REMADY
AFTER MSG CONFIRMATION DEPRESS ESC KEY

22 : 16 : 02

FIG. 40

WIRE STAMPING-AUTO

[EMU] FILE NAME <B:7112222. D01>

AUTO
STOP(ESC)
INTERRUPT(F. 1)

REQUIRED TIME
05 : 51 sec

REMAINING TIME
05 : 46 sec

COA NO.
B-747 PULSE = CONSTANT
COA11-2222 ER-01

<B:7112222. D01>

EQUIPMENT CONDITION

PRINTING CONDITION DURING EMERGENCY STOP (CONDITION OF RESPECTIVE EQUIPMENT)

| | |
|---|---|
| INK JET PRINTR | : JET OFF |
| HEAD TABLE | : POWER OFF |
| WIRE DRIVE | : POWER OFF |
| WIRE SELECT | : AIR S/O |
| TURN TABLE | : POWER OFF |
| PAPER PRINTER | : PRINT OUT |
| GUIDE/WIRE #5 | : F/3SJ-20 |
| GUIDE/WIRE #5 | : E/3SJ-24 |

WIRE NO. (DURING PRINTING) -----# -----ft-CLASS
W012-2F1018-24 24 5 SH-01

EMERGENCY MESSAGE

DURING EMERGENCY STOP SW DEPRESSION
AFTER TREATMENT COMPLETION, DEPRESS ESC KEY

22 : 36 : 15

FIG. 41

FILE NAME <B:6221203. D02>
COA NO. : B-767 COA22-1203 ER-02

| NO. | WIRE NO. | # | ft | CLASS |
|---|---|---|---|---|
| 001 | W5678-TA8767-24 | 24 | 5 | 2 |

WIRE STAMPING-AUTO

[EMU] FILE NAME <B:6221203. D02>

AUTO
START (f.10)
INTERRUPT(ESC)

REQUIRED TIME

REMAINING TIME

COA NO.
B-767
COA22-1203 ER-02

<B:7112222. $01>

EQUIPMENT CONDITION
PRINTING CONDITION
(CONDITION OF RESPECTIVE EQUIPMENT)
INK JET PRINTR :
HEAD TABLE :
WIRE DRIVE :
WIRE SELECT :
TURN TABLE :
PAPER PRINTER :
GUIDE/WIRE #5 : E/2SJ-24

WIRE NO. (DURING PRINTING)----- #------ ft-CLASS

EMERGENCY MESSAGE

EQUIPMENT IS NOT PREPARED
EXECUTE WARN UP
ESC KEY : TO MENU

SPACE・KEY : SHEET FEED

22 : 36 : 15

FIG. 42

1 : FILE 2 : DATA 3 : PRINT 4 : MAINTENANCE 5 : END [EMU] FILE NAME <B:7341089. D12>

PRINT

1 : AUTO
2 : SEMI AUT
3 : SET UP
4 : WIRE SET
5 : TO MENU

WIRE STAMPING

EXECUTION
INTERRUPTION(ESC)

MACHINERY CONDITION

PRINTING CONDITION DURING SET UP
(CONDITION OF RESPECTIVE EQUIPMENT)
INK JET PRINTR : COMMUNICATABLE
HEAD TABLE : SET COMPLETE
WIRE DRIVE : SET COMPLETE
WIRE SELECT :
TURN TABLE :
PAPER PRINTER :
GUIDE/WIRE #5 : E/2SJ-24
GUIDE/WIRE #5 : D/2SJ-22

MESSAGE AREA

WAIT A MOMENT

16 : 30 : 49

FIG. 43

FILE NAME <6221051. DAT B-767 COA22-1051 ER-1>

| NO. | WIRE NO. | # | ft | CLASSIFICATION |
|---|---|---|---|---|
| 001 | W123-2G1012-24 | 24 | 2 | SH-1 |
| 002 | W123-2G1013-24 | 24 | 2 | SH-1 |
| 003 | W123-2G1323-22 | 22 | 2 | SH-1 |
| 004 | W123-2G1612-20 | 20 | 2 | SH-1 |
| 005 | W123-2G1613-20 | 20 | 2 | SH-1 |

..... CUT FROM THIS LINE AND PUT IT IN BAG TOGETHER WITH WIRE .....

FILE NAME <6221051. DAT B-767 COA22-1051 ER-1>

| NO. | WIRE NO. | # | ft | CLASSIFICATION |
|---|---|---|---|---|
| 001 | W134-2G1012-24 | 24 | 2 | SH-2 |
| 002 | W134-2G1013-24 | 24 | 2 | SH-2 |
| 003 | W153-2G1323-22 | 22 | 2 | SH-2 |
| 004 | W150-2G1612-22 | 22 | 2 | SH-2 |
| 005 | W150-2G1613-22 | 22 | 2 | SH-2 |

..... CUT FROM THIS LINE AND PUT IT IN BAG TOGETHER WITH WIRE .....

FIG. 45

PRINTING APPARATUS FOR WIRE MATERIAL

TECHNICAL FIELD

The present invention relates to a printing apparatus for printing on a wire material such as wire cord. The apparatus is particularly suitable for printing identification display such as schema numbers or symbols on the surfaces of a plurality of different kinds of wire cords.

BACKGROUND ART

A tremendous number, such as several tens of thousands, of wire cords are utilized, for example, in the electrical systems of various equipment of an aircraft, and the wire cords have various, such as ten or more kinds, of outer diameters.

In order to prevent erroneous connection or trouble when such numerous wire cords are installed, identification displays such as schema numbers or symbols for the wires or wire cords on the basis of a manual are applied, and the wiring work is performed in accordance with the identification displays.

However, the wire cords have various diameters and, for example, include those each having a diameter of about 1 mm and also include twisted wires. Accordingly, special printing techniques are required for printing on such fine wire cords.

Heretofore, as shown in FIG. 7 as a schematic view, a type a is set and heated, and, by means of this type a, printing is carried out under pressure on a coating material d of a cord c through an ink ribbon b. In another method, the ink jet method, electric charges are applied to particles of an ink in accordance with the shapes of types preliminarily programmed, and these shapes of types are adsorbed on a printing surface However, in both of the above conventional methods, the printing is carried out for one cord per one operation. Accordingly, when it is necessary to carry out the printing on cords of various kinds or diameters in accordance with their usages and equipment to be used, extremely troublesome or difficult work is involved in changing printing contents, adjusting many items of equipment such as cord reels, cord guides and printing units and so on. Such troublesome work may not be a significant problem in the case of a relatively smaller number of kinds of wire cords, but in the case of extremely many kinds of wire cords such as in the equipment of an aircraft, it is considerably difficult to print different kinds of identification displays on these numerous members of wire cords.

SUMMARY OF THE INVENTION

In view of above described problems, the present invention aims to provide a wire material printing apparatus capable of carrying out the printing on many kinds of wire materials including small sized wire materials in a short time with high efficiency.

The present invention is characterized, as a means for solving the problems of the conventional art described above, by a printing apparatus for wire materials in which identification displays such as schema numerals and symbols for wire material such as electric wire cords are printed on the outer peripheries of the wire material. The printing apparatus comprises a selection and drive means for feeding plural kinds of wire materials, respectively, and selecting wire material corresponding to the one to be printed and a movable printing means to be moved to a position corresponding to the position of the wire material selected by and fed from the selection and drive means and adapted to print on the wire material. The selection and drive means of the present invention comprises driving rollers disposed correspondingly to plural kinds of stored wire materials, respectively, and a plurality of pinch rollers disposed opposingly to the driving rollers so that the wire materials contact the peripheral surfaces thereof so as to be pressed between the driving rollers and the pinch rollers, and the movable printing means is composed of an ink-jet-type printing head movably supported by a positioning table arranged in a direction transverse to the wire material feeding direction. The present invention also features a structure in which a length of the wire material to be fed is measured by a motor for driving the selection and drive means and an outer peripheral length of the driving roller. The invention also includes a structure in which a cutter is provided for the movable printing means at a portion crossing a path of the wire material so that the wire material is cut when the movable printing means is moved.

The invention further includes a drive control means for controlling the selection and drive means and the movable printing means so that printing is made on a wire material designated by associated printing data, a wire data storing means for storing data related to the different wire material to be printed upon (e.g., the contents of the identification displays and class identification marks of the wire materials), and a data take-out means for taking out the data from the data storing means one-by-one so that the wire materials having the same class identification marks are continuously taken out. Also, the invention features means for transmitting the take-out data to the drive control means as printing data.

The invention further features a structure which includes a drive control means for controlling the selection and drive means and the movable printing means so that printing is made on associated wire material designated by a printing data, wire data storing means for storing a data pertaining to a wire material to be printed upon (including the contents of the identification displays and class identification marks of the wire materials), a data take-out means for taking out the data from the data storing means one-by-one and transmitting such take-out data to the drive control means as printing data, a time calculation means for calculating the time required for printing all the data of the plurality of wire materials to be printed, and time display means for displaying results calculated by the time calculation means.

The invention is also characterized by a structure that includes a drive control means for controlling the selection and drive means and the movable printing means so that printing is made on associated wire material designated by a printing data, a wire data storing means for storing data pertaining to wire material to be printed (including the contents of the identification displays and class identification marks of the wire materials), a data take-out means for taking out the data from the data storing means one-by-one and transmitting such take-out data to the drive control means as printing data. This embodiment of the present invention also includes a data input means for inputting the wire mat data, a stored instruction input means for inputting first stored instructions, an input data holding means for holding the input data from the data input means, a wire material data write control means for writing the data of the data input means in the wire material storing means in response to second stored instructions, and a data rule discrimination means for discriminating whether or not the data of the input data holding means conforms with a preliminarily set rule in response to the first stored instructions and, only in the case of conformity, transmitting the second stored instructions to the write control means.

The present invention also features a stored data holding means, a data copy means functional at the data storing time for copying the data of the input data holding means into the stored data holding means in response to the second stored instructions, a specific operation requiring input means for inputting a specific operation requirement, and a data copy means at the data input time for copying the data of the stored data holding means into the input data holding means in response to the specific operation requirement.

The invention still further features a structure that includes a drive control means for controlling the selection and drive means and the movable printing means so that printing is made on a wire material designated by associated printing data, a wire data storing means for storing data pertaining to wire material to be printed including the contents of the identification displays and class identification marks of the wire materials. The structure further includes a data take-out means for taking out the data storing means one-by-one and transmitting such take-out data to the drive control means as printing data, a data conversion means extracting constructional elements of the data of the wire material to be printed in an existing data package prepared by a predetermined writing style and converting the extracted data into the data of the wire material to be printed, and data writing control means for writing the converted data into the wire material storing means.

Thus, according to the present invention, a plurality of different kinds of wire materials are set to be feedable to the selection and drive unit, and the wire materials and the identification display contents to be printed on the wire materials are inputted into the movable printing unit. According to this process, the selection and drive unit corresponding to the movable printing unit is driven and the wire material is fed. The movable printing unit is positioned on the way of the path of the wire material to carry out the printing operation on the wire material. In this manner, the predetermined identification display can be printed on the necessary wire material.

BRIEF DESCRIPTION OF THE DRAWINGS

FIG. 29 is a chart for a description of a displayed image surface due to "DATA FILE DISPLAY" of FIG. 11.

FIG. 30 is a chart for a description of a displayed image surface due to "FILE NAME DISPLAY" of FIG. 11.

FIG. 31 is a table for a description of a data format of an application soft "LOTUS 1-2-3".

FIG. 32 is a table for a description of a data format after extraction of a necessary data in "DATA CONVERSION" of FIG. 14.

FIG. 33 is a table for a description of a data format when the data extracted in the "DATA CONVERSION" of FIG. 14 is subjected to the format conversion as a text file.

FIG. 35 is a chart for a description of an image surface during the execution of the automatic printing mode.

FIGS. 36 to 40 are charts showing image surfaces indicated to the operator when the printing operation is stopped in an emergency in accordance with various factors.

FIG. 41 is a chart for a description of an image surface indicated to an operator in case of shortage of the remainder of a disk at the time of file writing processing in the file processing mode.

FIG. 42 is a chart for a description of an image surface due to "EQUIPMENT CONDITION DISPLAY" in the automatic printing mode processing shown in FIG. 26.

FIG. 43 is a chart for a description of an image surface due to "SET UP INDICATION DISPLAY" in the processing of FIG. 42.

FIG. 45 are tables for a description of a classification sheet of the automatic printing mode.

BEST MODE FOR CARRYING OUT THE INVENTION

The present invention will be described hereunder with reference to an embodiment represented by the drawings.

Figure 1:
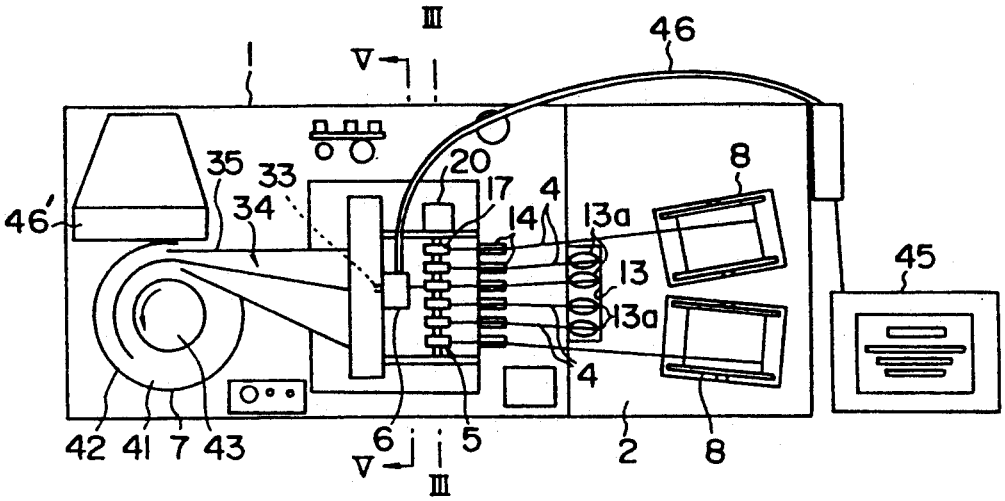
FIG. 1 is a plan view of one embodiment of a printing machine for wire materials such as wires or wire cords according to the present invention.
Figure 2:
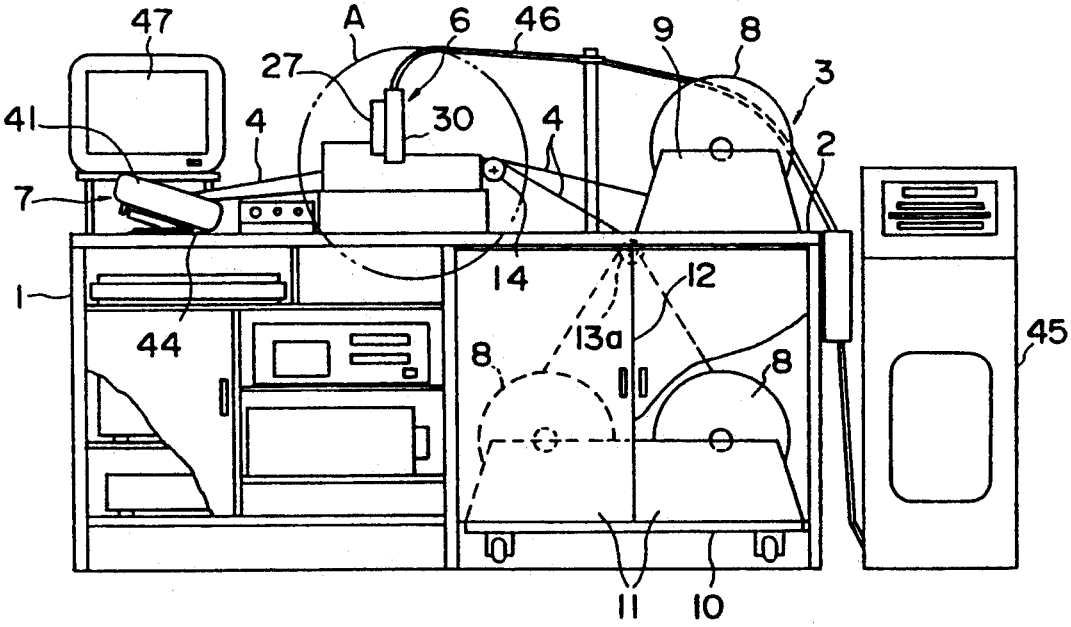
FIG. 2 is a side view of the wire material printing machine of FIG. 1.
Figure 3:
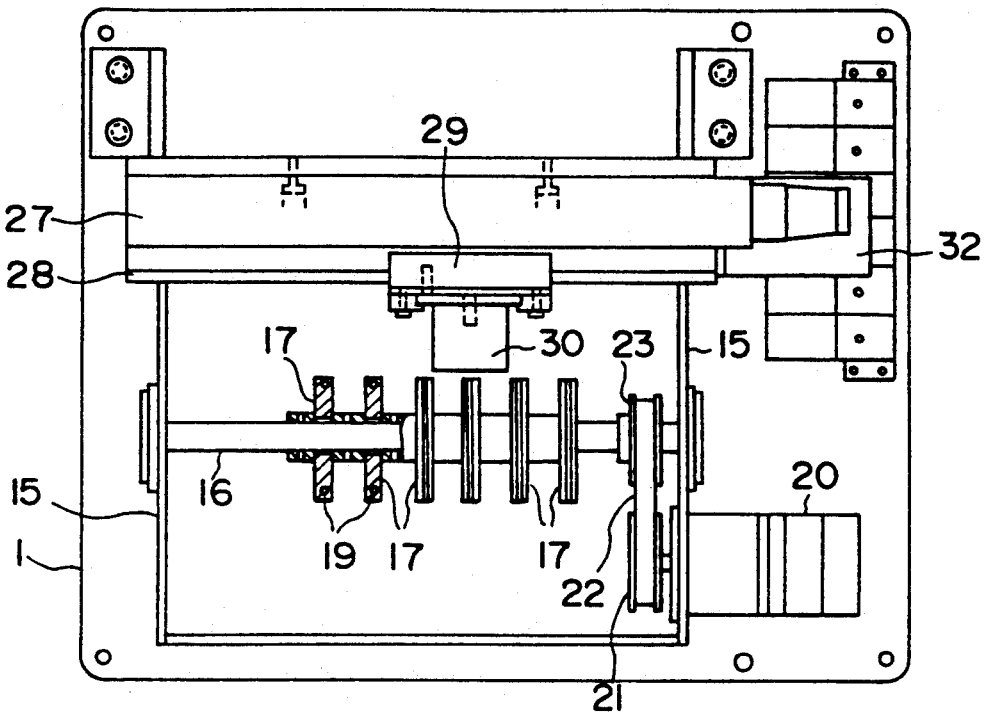
FIG. 3 is a detailed plan view of a portion A of FIG. 2.

FIG. 1 is a plan view showing the general structure of a wire material printing apparatus according to the present invention. FIG. 2 is a side view thereof.

A wire cord storing unit 3 is provided at an upper surface of one end of a top plate 2 of a base table 1 and at a lower portion thereof, and subsequently in order, a selecting and driving unit 5 for selecting the wire cord 4 and then feeding it, a movable printing unit 6 for carrying out a printing operation to the selected and fed wire cord 4, and a recovery unit 7 for recovering the printed wire cord after it has been cut.

The wire cord storing unit 3 supports shafts of a plurality of reels 8, 8, --- around which different kinds of wire cords 4 are respectively wound. In the illustrated example, six reels are supported, two being disposed above the upper surface of the top plate 2, and four being disposed below the top plate 2. The reels 8, 8 disposed on the upper surface of the top plate 2 are so supported that the shaft ends of the reels 8, 8 are rotatably mounted on bearing portions formed at the upper ends of bearing plates 9, 9 vertically provided on the top plate 2. The other reels 8, 8, --- disposed below the top plate 2 are mounted on a bogie 10 which can be freely taken out with respect to the base table 1. The shaft ends of two pairs of reels 8, 8, --- are rotatably mounted on bearing portions formed on the upper ends of two pairs of bearing plates 11, 11 vertically provided on the upper surface of the bogie 10. The bogie 10 is freely accommodated and taken out by opening or closing doors 12 of the base table 1. The bearing portions of the respective reels have friction applying mechanisms to thereby apply proper braking action to the reels so as to prevent the wire cords from being slackened excessively.

The wire cords 4, 4 drawn out from the reels 8, 8 disposed above the upper surface of the top plate 2 are guided as they are to the selecting and driving unit 5, whereas the wire cords 4, 4, --- drawn out from the reels 8, 8, --- mounted on the bogie 10 disposed below the top plate 2 are guided to the selecting and driving unit 5 through wire cord draw-out holes 13, 13, --- formed through the top plate 2. Guide reels 14, 14, --- are provided for the paths of the respective wire cords 4, 4, --- towards the selecting and driving unit 5 for determining spaces between respective wire cords 4, 4, --- guided to the selecting and driving unit 5.

That is, these reels 8, 8, --- and guide reels 14, 14, --- are arranged as pairs respectively, thus, there are six sets in the illustrated example. The kinds of the wire cords mounted in four of these six sets of reels 8 and 14 are constantly determined, and the wire cords mounted in the other two sets thereof are exchangeable.

Figure 4:
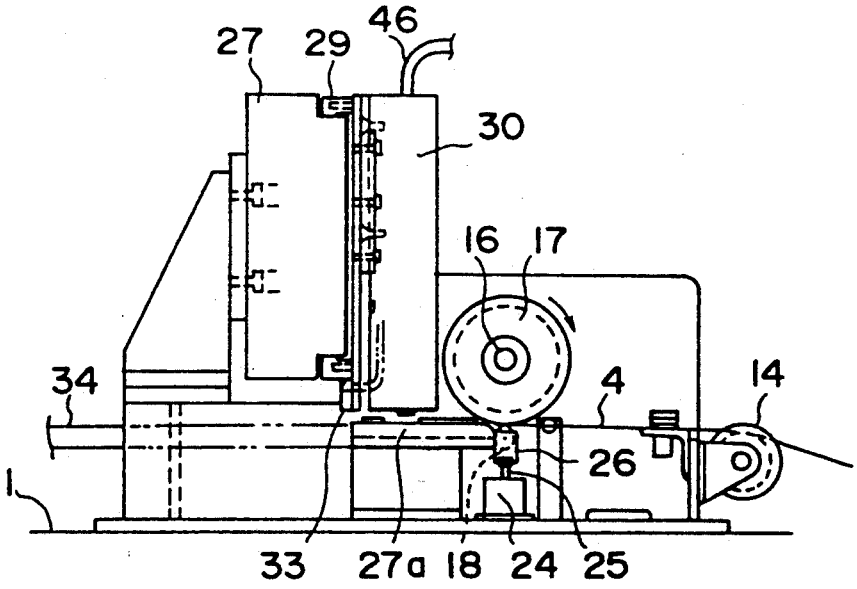
FIG. 4 is a detailed side view of a portion A of FIG. 2.

The selecting and driving unit 5 comprises, as shown in FIG. 4, frames 15, 15 rising vertically at bilateral portions with respect to the wire cord feeding direction on the base table 1, a plurality of driving rollers 17, 17, --- mounted on a shaft 16 supported between the frames 15, 15 and a plurality of pinch rollers 18, 18, --- disposed opposingly to the driving rollers 17, 17, --- so as to be forcibly pressed against the peripheral surfaces of the driving rollers 17, 17, --- over the wire cords 4, 4, --- interposed therebetween.

Each of these driving rollers 17 is formed as a pulley provided with a circumferential groove into which a rubber ring 19 is fitted to produce a large friction force at the peripheral surface thereof. The shaft 16 on which the driving rollers 17, 17, --- are mounted is rotated in the direction of the arrow in FIG. 4 by a motor 20 through a pulley 21, a belt 22 and a pulley 23.

Each of the pinch rollers 18 in the illustrated example is mounted to a bearing member 26 disposed at a front portion of a rod 25 of an air cylinder 24 secured perpendicularly on the base table 1. When pressurized air is supplied to the air cylinder 24, the rod 25 is displaced upwardly so that the pinch roller 18 causes the wire cord 4 to contact the periphery of the driving roller 17 under pressure, and the wire cord 4 is thereby fed in accordance with the rotation of the driving roller 17 through frictional force therebetween. The elevating motion of the pinch roller 18 may be accomplished by a solenoid means or a mechanical cam mechanism in place of pressurized air.

Figure 5:
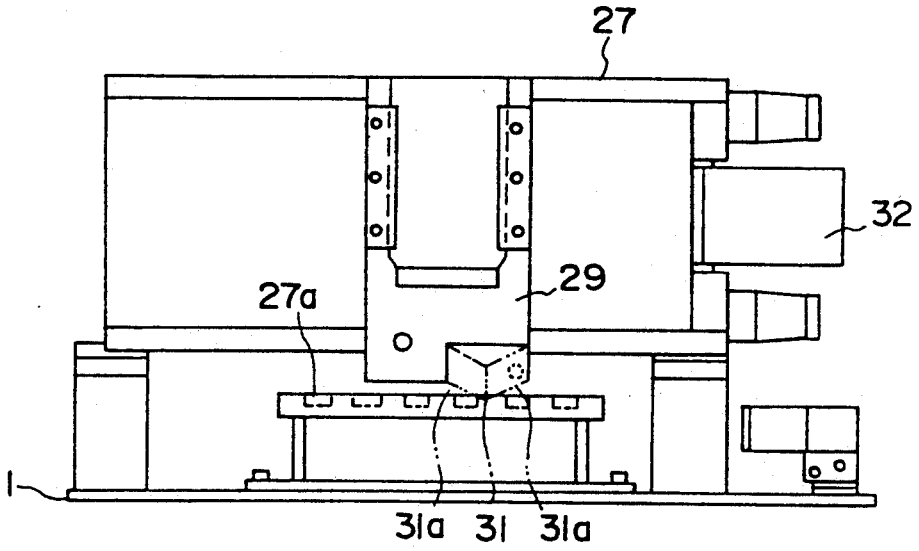
FIG. 5 is a sectional view taken along the line V—V of FIG. 1.

The movable printing unit 6 includes a positioning table 27 secured to the base table 1 in a direction crossing, but necessarily not normal to, the feeding direction of the wire cord 4 and a printing head assembly which includes an ink-jet-type printing head 30 and a movable pedestal 29. Head 30 is mounted to movable pedestal 29 laterally movably carried by rails 28 of the positioning table 27. As shown in FIG. 5, a cutter 31 having a downward angle shape and provided with cutting edge portions 31*a*, 31*a* is secured to the movable pedestal 29. The cutting edge portions 31*a* , 31*a* are arranged to be movable together with the movable pedestal 29 across the feeding paths of he wire cords 4, 4, ---.

The movable pedestal 29 is moved by a screw means in which a screw, not shown, rotated by the operation of a motor 32 mounted on the positioning table 27 is engaged with a female thread formed in the movable pedestal 29, or by an engaging means including a rack and pinion engagement mechanism, or some other suitable means. The movable pedestal 29 is stopped at a position directly above the selected wire cord 4 so that the printing head 30 of the printing means 6 just opposingly corresponds to the selected wire cord 4.

Below the positioning table 27 are formed passages 27*a* through which the wire cords 4, 4, --- are respectively passed and air blow-out ports 33 are formed on the outlet sides of the passages 27*a* to dry the ink printed by the printing head 30.

Figure 6:
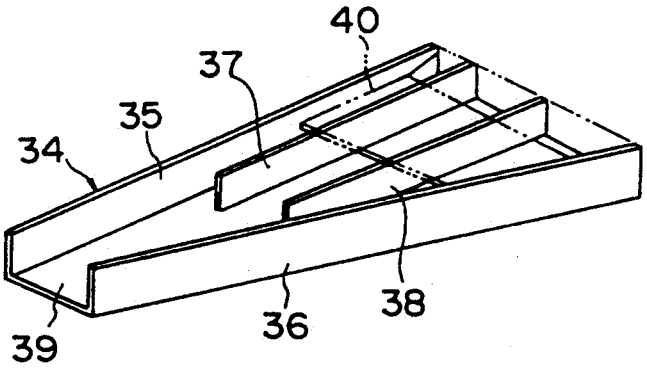
FIG. 6 is a perspective view of a trough member for guiding the wire cords.
Figure 7:
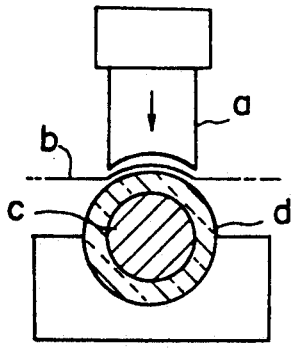
FIG. 7 is a schematic sectional view showing a conventional printing unit.

A trough member 34 for guiding the wire cord 4 printed and then cut to the predetermined length towards the recovery unit 7 is connected to the passage 27*a* at the outlet port of the wire cord 4 of the positioning table 27. The trough member 34 has, as shown in FIG. 6, one side wall 35 parallel to the feeding direction of the wire cord 4 and another side wall 36 tapered with a specific angle of the order of 30°. A plurality of guide wall plates 37 and 38 (two in the illustration) are also arranged so that the cut wire cords 4 are guided by the side walls 35, 36 and guide wall plates 37, 38, with the front leading ends of the wire cords abutting against the tapered wall surface of the side wall 36, toward an outlet port 39. An upper portion of the trough member 34 is covered by a cover 40 having a wide height portion near the outlet side of the wire cord of the positioning table 27, a portion having a height gradually reduced therefrom and finally a flat portion.

The recovery unit 7 includes an annular cup-shaped case 41 having a peripheral wall 42, and the outlet port 39 of the trough member 34 faces the case 41 in the tangential direction thereof. The case 41 is disposed with a downward inclination towards the outlet portion 39 of the trough member 34 and is provided with a bottom portion at the central portion of which a disc-shaped core member 43 is disposed. These members are rotated by a motor 44 mounted at the lower part of the case 41.

Referring to FIGS. 1 and 2, reference numeral 45 denotes an ink-jet-type printing unit, which is communicated with the printing head 30 through a hose 46. Reference numeral 47 denotes display means of a computer 46'.

The example of the printing apparatus for wire material of the structure described above operates as follows.

A plurality of reels 8, 8, --- around which a plurality of wire cords 4, 4, --- are wound are respectively mounted on the bearing plates 9 and 10 of the wire cord storing unit 3. The wire cords 4, 4, --- drawn out from respective reels 8, 8, --- are guided between the driving rollers 17, 17, --- and the pinch rollers 18, 18, --- of the selecting and driving unit 5, respectively, through the guide reels 14, 14, ---.

After this preliminary setting of the wire cords, when the printing apparatus starts to operate, a series of operations including selecting, printing, cutting and recovering of the wire cords 4, 4, --- are performed in response to command signals from the computer in which the series of operations are preliminarily programmed in accordance with an operation manual. That is, in a case where one wire cord 4 is selected, the pressurized air is fed to the air cylinder 24 of one pinch roller 18 of the selecting and driving unit 5 through which the selected wire cord 4 passes, and the pinch roller 18 is then moved upward to thereby press the wire cord 4 against the peripheral surface of the driving roller 17, whereby the wire cord 4 is fed by the rotation of the driving roller 17.

According to the selection of the wire cord 4 as described above, the moving position and the printing content of the movable printing unit 6 are determined. The movable pedestal 29 is then moved onto the feeding path of the wire cord 4 so that the printing head 30 faces the wire cord 4, and the printing operation is carried out by the ink-jet-type printing method. The portion printed is pressed by pressure of air blown from the air blow-out port 33 at the exit of the positioning table 27 so that the wire cord 4 advances without being swung and is fed towards the recovery unit 7 through the trough member 34. During this process, the pitch of the printing positions to the wire cord 4 is so determined as to carry out the printing operation with constant interval in accordance with the wire cord feeding speed and the printing interval of the printing head 30. The identification display may be identified from any direction after the printing operation because of proper displacement of surfaces to be printed of the wire cord due to the self-twisting property of the wire cord 4. The length to be cut of the wire cord 4 is counted in response to the number of revolutions of the driving roller 17. When the feeding amount of the wire cord 4 reaches the predetermined length, the ink injection from the printing head 30 is stopped, and the movable pedestal 29 is then moved to the cutting position, at which the wire cord 4 is cut by the cutter 31 to the predetermined length. The wire cord 4 thus cut is taken up around the outer periphery of the core member 43 along the peripheral wall 42 of the rotating case 41 of the recovery unit 7.

In accordance with the described operation, the wire cords 4, 4, --- are successively selected, printed and then cut to the predetermined length, thus printing the predetermined identification displays on the wire cords 4, 4, --- in accordance with the predetermined program. The cut wire cords 4, 4, --- are finally recovered in the recovery unit 7.

When it is desired to heat the wire cords 4, 4, --- for ensuring the drying and fixing of the ink after the printing operation, a heating means such as oven may be independently prepared, and the wire cords stored as a bundle in the recovery unit 7 are moved into the oven and then heated there.

The controlling of the operations of these mechanisms is carried out by a computer, and the control system together with units or elements associated therewith will be described hereunder with reference to the accompanying drawings mainly including various flowcharts.

Figure 8:
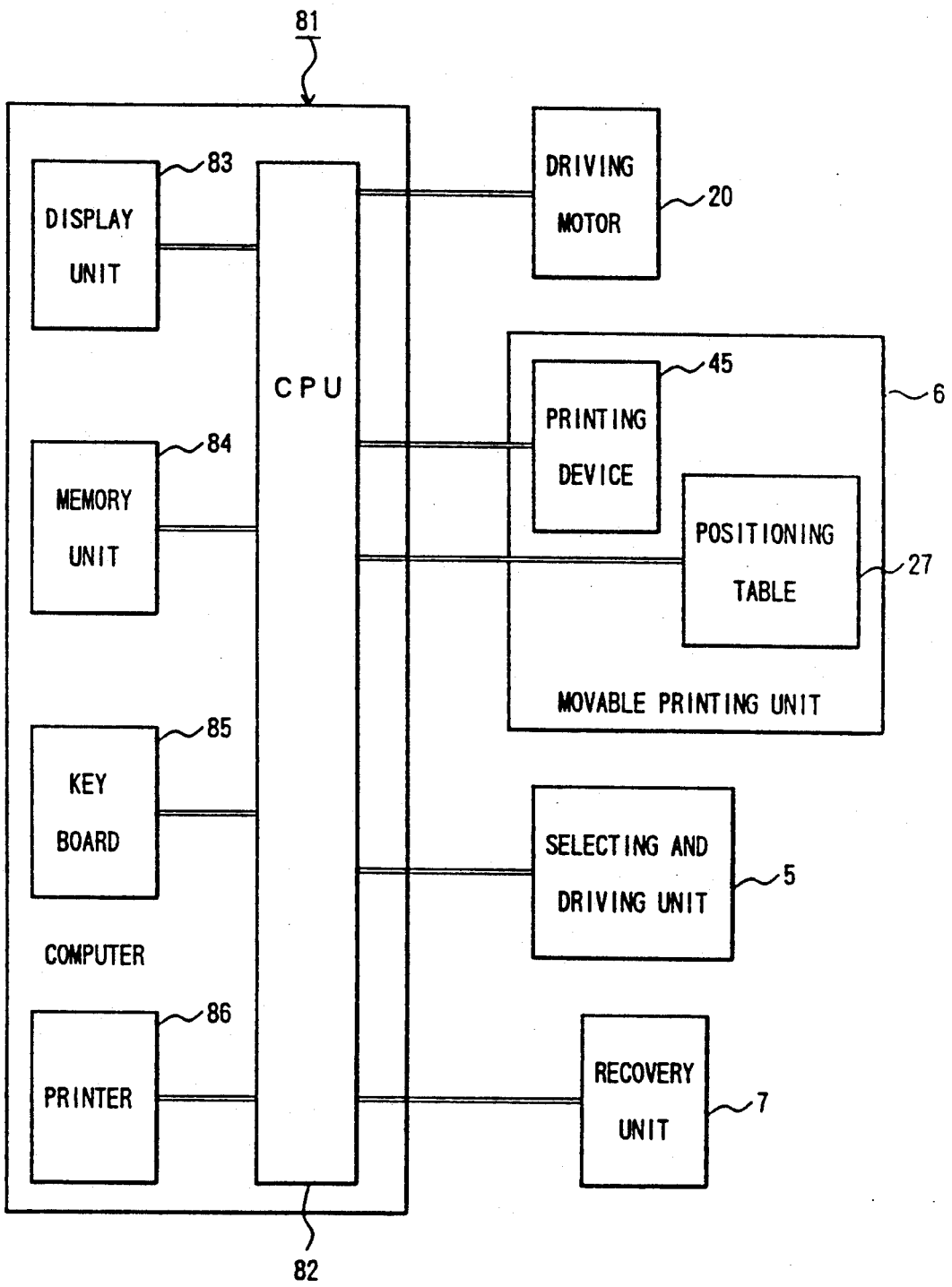
FIG. 8 is a block diagram showing the general organization of a system of the present invention.

First, FIG. 8 is a system block diagram of the wire material printing apparatus according to the present invention.

Referring to FIG. 8, the computer 81 generally comprises a central processing unit (CPU) 82, a display unit 83, an external memory unit 84, a key board 85 and a printer 86. The CPU includes a ROM (Read-Only-Memory) in which program represented by FIGS. 9 to 28 are stored, and the aforementioned controlling of the mechanisms and the forwarding of various functions are performed by executing these programs.

The display unit 83 comprises a CRT (cathode ray tube) display, for example. The memory unit 84 comprises a floppy disk device, for example, and stores printing data files and the like. The key board 85 is manipulated by an operator for giving various instructions to the system and preparing data for the printing. All operations for the system are executed by the operation of the key board 85. The printer 86 is utilized for printing out classification sheets and the like described hereinlater.

The selecting and driving unit 5, the movable printing unit 6, the recovery unit 7 and the wire cord driving motor 20, which are described hereinbefore, are operatively connected to the CPU 82 and controlled thereby.

Figure 9:
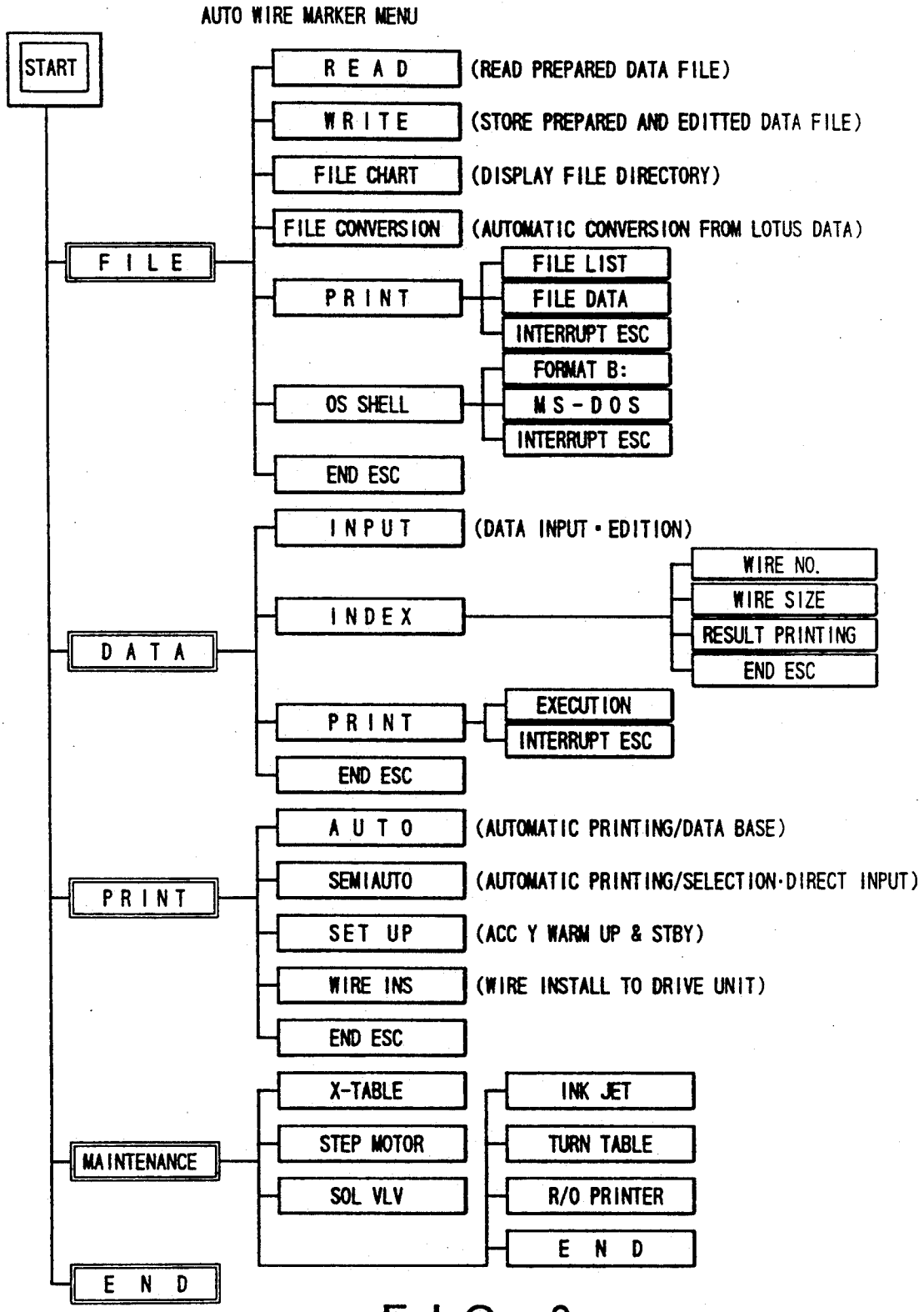
FIG. 9 is a system block diagram showing a mode selection menu of a CPU of the system structure of the invention.
Figure 10:
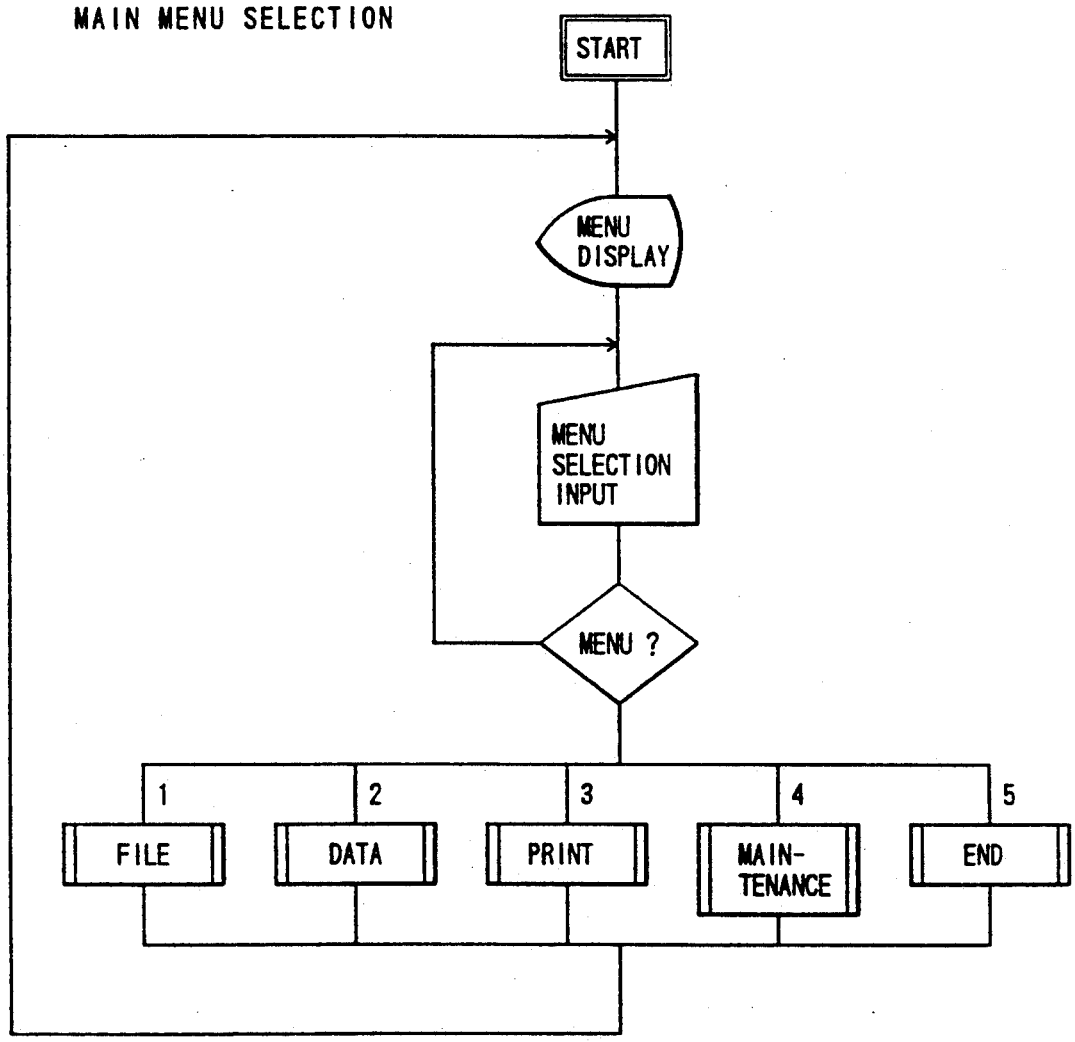
FIG. 10 is a flowchart of a main routine for carrying out the mode selection.

FIG. 9 represents a processing menu of the CPU 82, which will be broadly classified into a file processing mode (FILE), a data processing mode (DATA), a printing mode (PRINTING) and a maintenance mode (MAINTENANCE). FIG. 10 shows a main routine of the system. The respective modes are branched to routines of the respective menus by the execution of the main routine of FIG. 10. These branching workings correspond to the mode indications of the operator through the operation of the key board 85.

The indication of the mode is performed by, for example, displaying, on a display image surface or screen, the file processing mode (FILE), the data processing mode (DATA), the printing mode (PRINTING) and the maintenance mode (MAINTENANCE) correspondingly to their numbers, by inputting the numbers and by pushing a return key. Accordingly, the display image surface is specified according to the inputted mode. When the mode is to be released or allowed to escape, an escape key (ESP) is pushed and the image surface then returns to the original main image surface.

The following modes are respectively selected: a file processing mode (FILE) for the processing of the file after the preparation thereof, a data processing mode (DATA) for the processing of a new preparation or renewal of a file data, a printing mode (PRINTING) for printing the wire cord, and a maintenance mode (MAINTENANCE) for performing operation tests of the respective items of equipment and units.

The file processing mode (FILE) is a mode processing the prepared file and is composed of a read mode, a write mode, a file chart mode (FILE CHART), a file conversion mode (FILE CONVERSION), printing mode and an auxiliary mode (OS SHELL). When this file processing mode is selected, a directory of the floppy disk is read and a display image surface such as that shown in FIG. 29 is formed.

In this display image surface, a selection menu is displayed on a column of "FILE", and the selection of the menu is carried out by inputting a numeral "1" to "7", or by positioning a cursor (arrow) of the number "1" to "7" and depressing the return key.

In a column "DIR**", the number of the file stored in the floppy disk in which the directory is read is displayed, and in a column to the right of this column, the file number in which the directory is displayed is also displayed.

In this directory display column are displayed file names of the respective files, numbers of the wire cords, date of preparation of the files and so on. When the operator selects a file for the reading or the writing, he moves the cursor to a line of the objective file in the display column and then depresses the return key, thus selecting the objective file. In addition, the file selection may be performed by inputting the objective file name into a "FILE NAME INPUT" column and then depressing the return key.

The read mode is a mode reading the prepared mode stored in the external memory unit 84 such as a floppy disk into an internal RAM (Random-Access-Memory). This processing is represented by the flowchart of FIG. 11.

Figure 11:
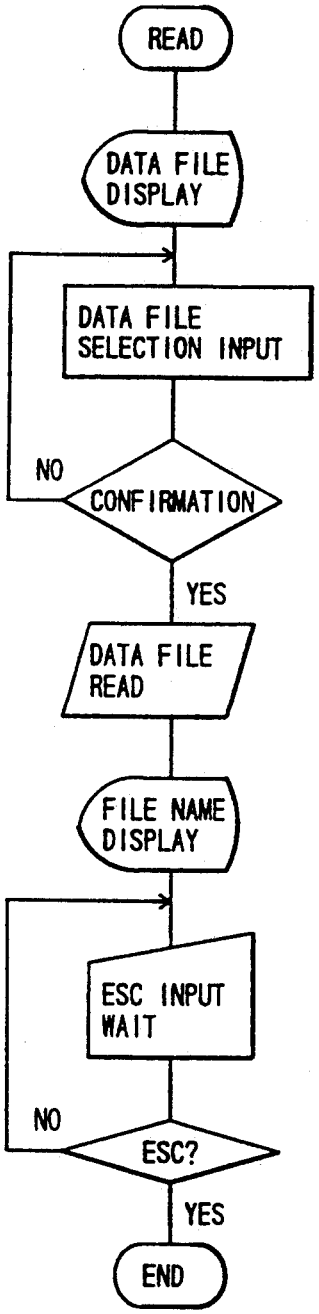
FIG. 11 is a flowchart representing a reading processing of a file processing mode (FILE).

The display image surface or screen of FIG. 29 is formed in accordance with the "DATA FILE DISPLAY" shown in FIG. 11, and a file in its directory display column is selected. Then, when the file is selected and inputted, the data file reading is carried out. When the reading is ended, a display such as that shown in FIG. 30 is displayed, and this routine is completed by carrying out the ESP inputting.

The "CONFIRMATION" in FIG. 11 represents a processing, at a time when a file name is directly inputted to designate the file, for checking whether or not a file corresponding to the designated file name exists.

Figure 12:
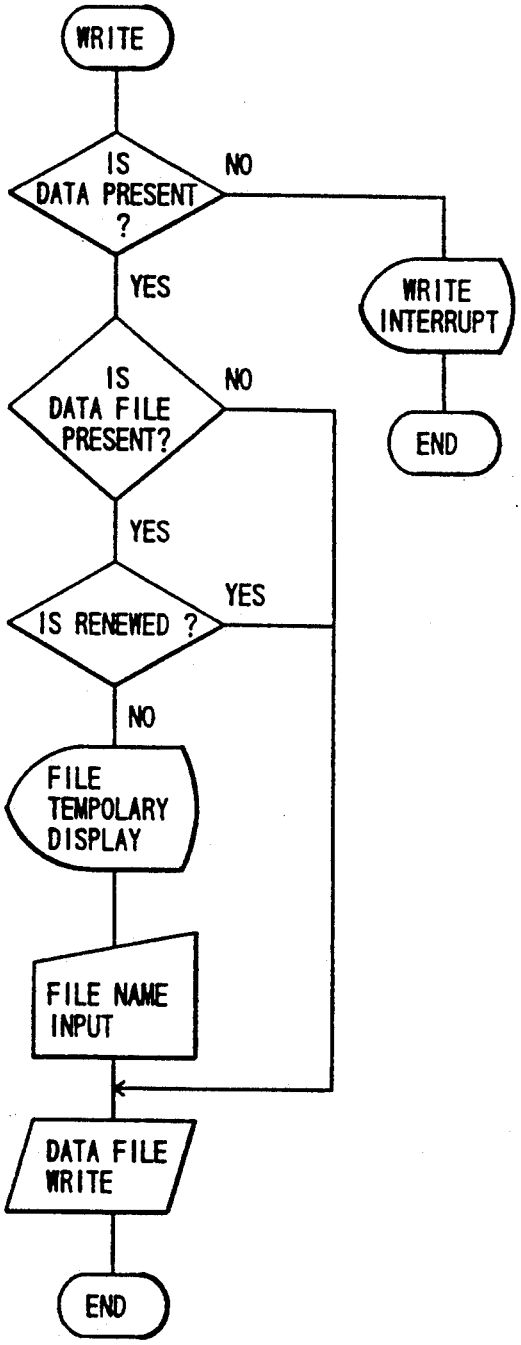
FIG. 12 is a flowchart representing a writing processing of a file processing mode (FILE).

The writing mode is a mode storing the file data prepared in the RAM area as one file into the external memory unit 84, and the processing of this writing mode is represented by FIG. 12.

Referring to FIG. 12, the presence or absence of data to be filed is first checked. In the case of absence of such data, the writing is stopped there. In the case of the presence of such data, presence or absence of the data of the same file name is checked, and in the case of the absence of such data, the writing of such data in the floppy disk is executed. On the contrary, in the presence of the same file name data, whether or not the file of this file name should be renewed is checked. When the renewal of the file name is made, the writing of the file data of this file name is performed as it is. When the data is written as a different file, not renewal, the chart of the file names is displayed, and the operator writes that file with a file name not listed in the chart.

Figure 13:
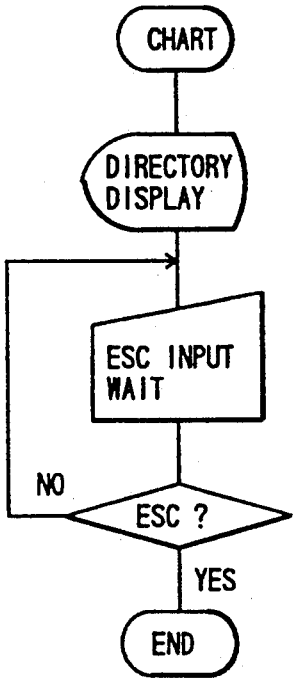
FIG. 13 is a flowchart representing a file chart processing.

The file chart mode is a mode displaying file stored in one floppy disk. This processing is represented by FIG. 13.

Figure 14:
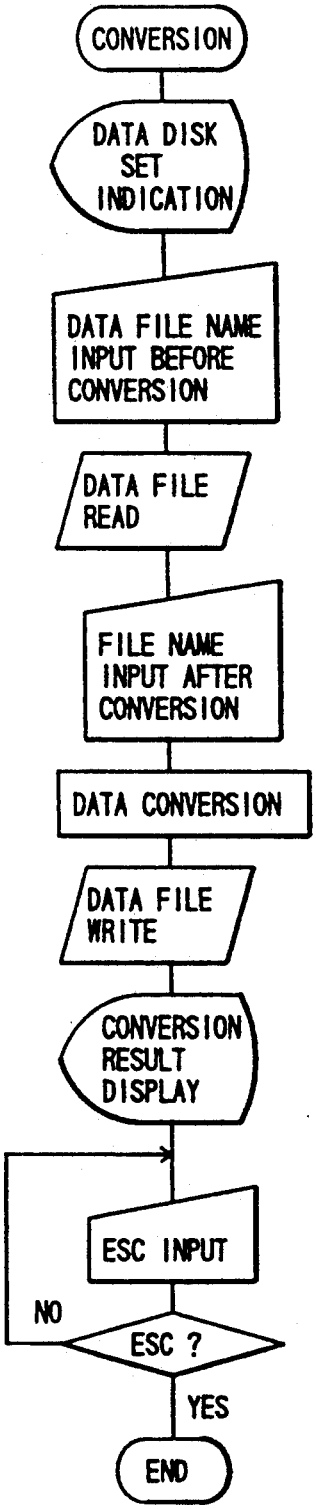
FIG. 14 is a flowchart representing a file conversion processing.

The file conversion mode is a mode converting the data of an application soft, for example, data of LOTUS, into a format suitable for the subject system. This processing is represented by FIG. 14.

Then, FIG. 31 shows data based on data format of the "LOTUS 1-2-3", and this LOTUS data is read by the "DATA FILE READING".

After the completion of this processing, the operator inputs the file name after the conversion.

Next, in the processing of "DATA CONVERSION", only the necessary data shown in FIG. 32 is extracted from the data shown in FIG. 31 and then converted as text file for the subject system shown in FIG. 33.

In "RESULT DISPLAY", the data is displayed with the mode shown in FIG. 33.

The printing mode contains a list printing (FILE LIST) and a data printing (FILE DATA). The list printing is a process in which the directory chart displayed and processed by the file chart mode is printed by the printer 86. The file data printing is a process in which a file data now being displaying as processing result of the reading mode, the file conversion mode, etc. is printed by the printer 86. The processing of these printing modes is represented by FIG. 15.

Figure 15:
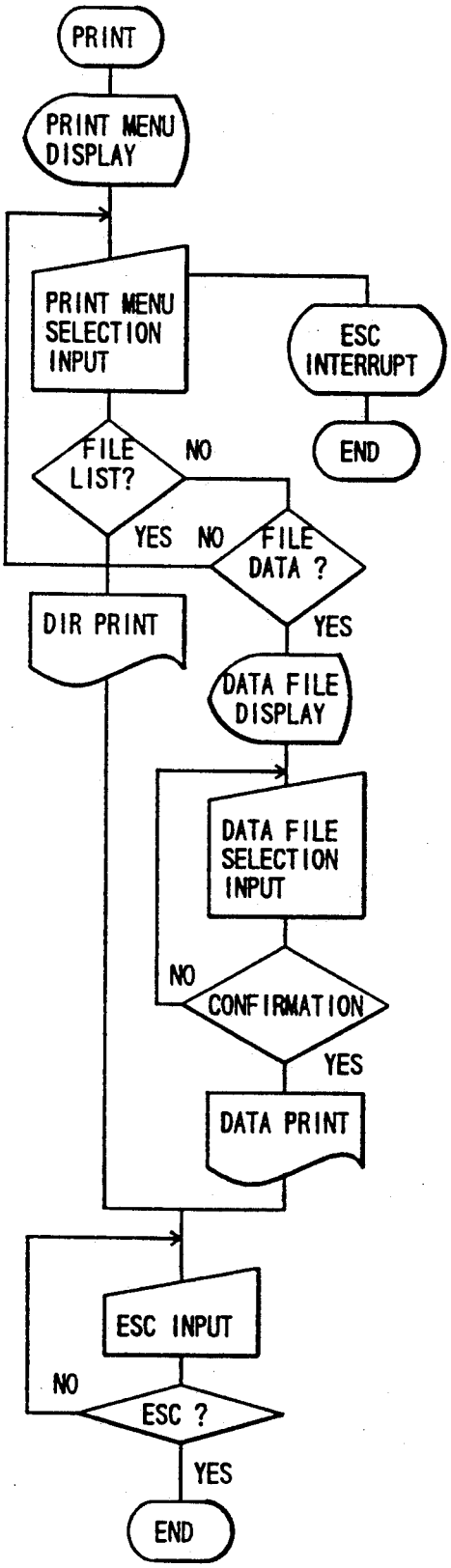
FIG. 15 is a flowchart representing a printing processing.

Referring to FIG. 15, the "FILE LIST" and the "FILE DATA" are first displayed as a printing menu. The operator then selects either one of them while observing the display. On the basis of this selection, either the "FILE LIST" or "FILE DATA" is selected. When the "FILE LIST" is selected, the directory printing is performed, and when the "FILE DATA" is selected, the data read by the file selection of the operator is printed.

The auxiliary mode (OS SHELL) contains a format processing (FORMAT:B) and an operation system conversion processing (MS-DOS). The format processing carries out an initiation of the floppy disk, and the operation system conversion processing carries out the returning of the system operation mode to a command level of the MS-DOS, enabling the working at the command level of the MS-DOS. This processing of the mode is represented by FIG. 16.

Figure 16:
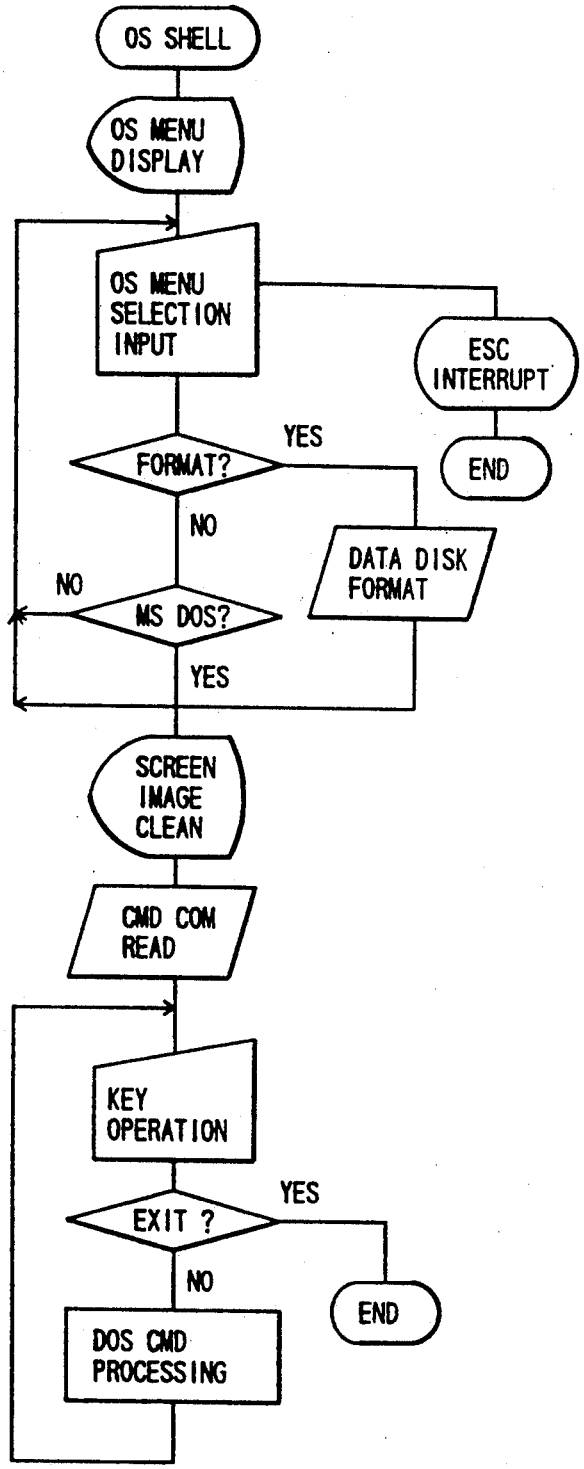
FIG. 16 is a flowchart representing an OS SHELL processing.

Referring to FIG. 16, the "FORMAT:B" and "MS-DOS" are first displayed as OS menu. When the operator carries out the selection inputting, the input is checked.

Figure 34:
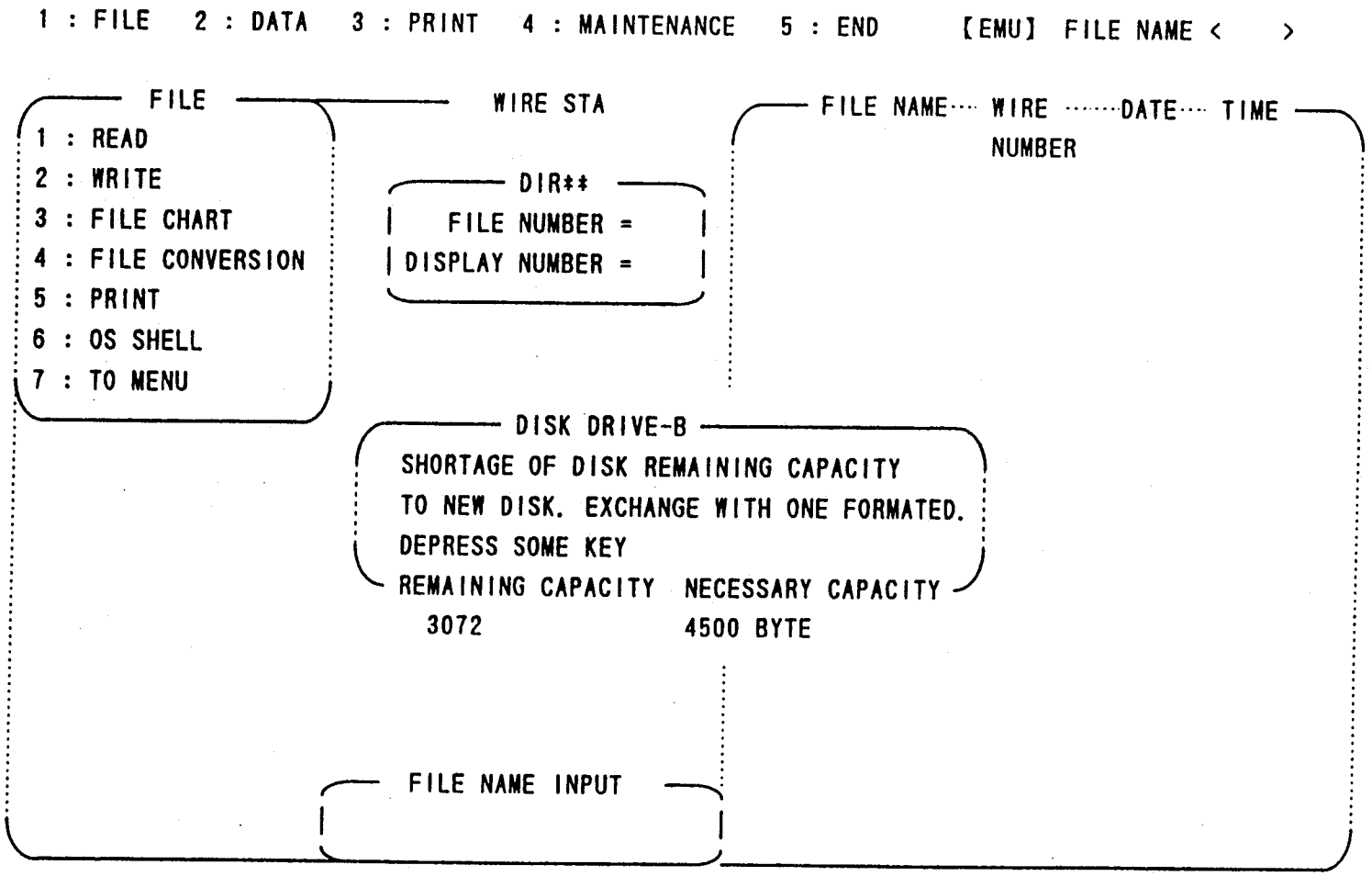
FIG. 34 is a chart for a description of an input mode image surface of a data processing mode.

When the "FORMAT:B" is inputted, the initiation of the floppy disk is carried out. In the case of shortage of remainder capacity of the floppy disk at a time of writing of the file in the writing mode, an image display as shown in FIG. 34 is displayed. In this case, when the initiated floppy disk cannot be prepared, the "FORMAT:B" is selected to newly initiate the floppy disk.

When the "MS-DOS" is inputted, the display now being displayed is released and the reading of CMD COM is carried out. According to this processing, the operator can operate at the MS-DOS command level. When it is necessary to carry out a key operation, its content is checked and a processing is executed in conformity with the command. This operation is repeated until "EXIT" is inputted by the operation of the key.

Figure 17:
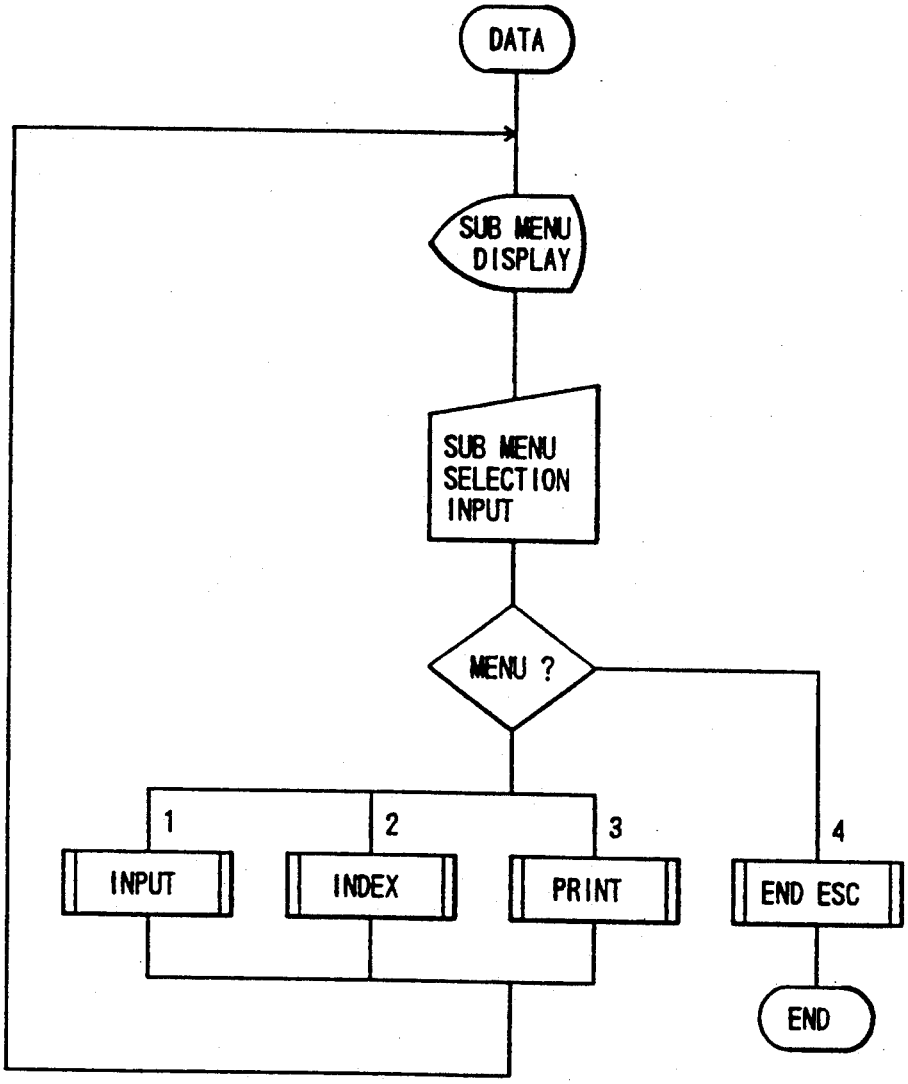
FIG. 17 is a flowchart representing a data processing mode.

The data processing mode (DATA) includes an input mode (INPUT), an indexing mode (INDEX) and a printing mode (PRINTING) and is branched to the respective modes in response to an indication of the operator by executing the processing represented by the flowchart of FIG. 17.

That is, as shown in FIG. 35, sub-menus of "INPUT", "INDEX" and "PRINTING" are displayed in the "DATA" column, and the operator moves the cursor to either one of these sub-menus and depresses the return key to thereby input a mode corresponding to the selected sub-menu.

Figure 18:
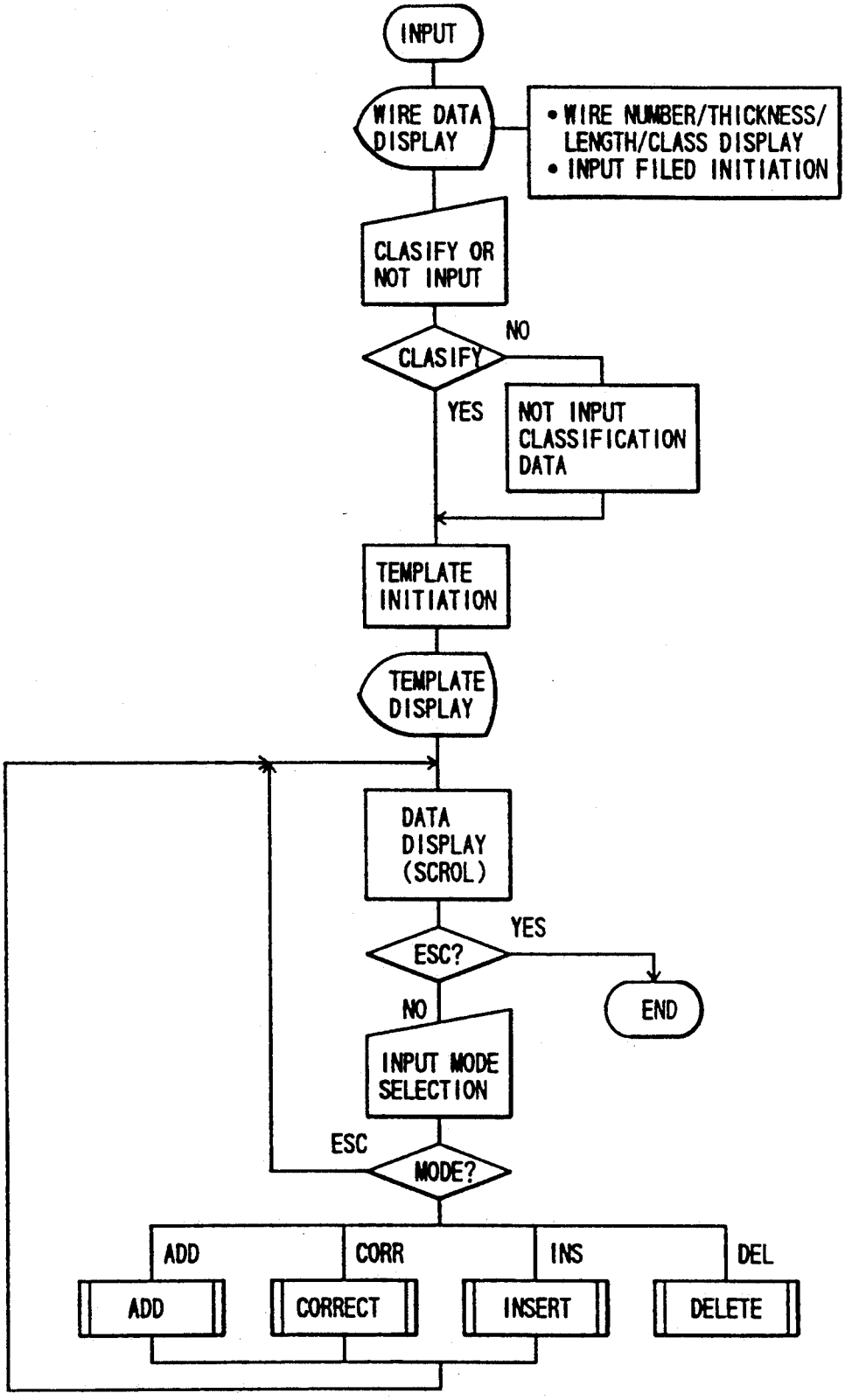
FIG. 18 is a main-routine flowchart of the input mode of the data processing.

The input mode is a mode for inputting and editing the data as shown in FIG. 18. As shown in FIG. 18, an addition mode, a correction mode, an insertion mode and a removal mode are included. These modes are branched in accordance with the selection and inputting of the operator.

That is, first, a column of "DATA INPUT" as an input field of the image surface shown in FIG. 35 is initiated. Then, presence or absence of necessity of the classification data is discriminated, and in accordance with this discrimination, a template is initiated. FIG. 35 shows a case of the presence of the classification input. Thereafter, the branching into the respective modes is carried out in response to such mode selection and inputting.

Figure 19:
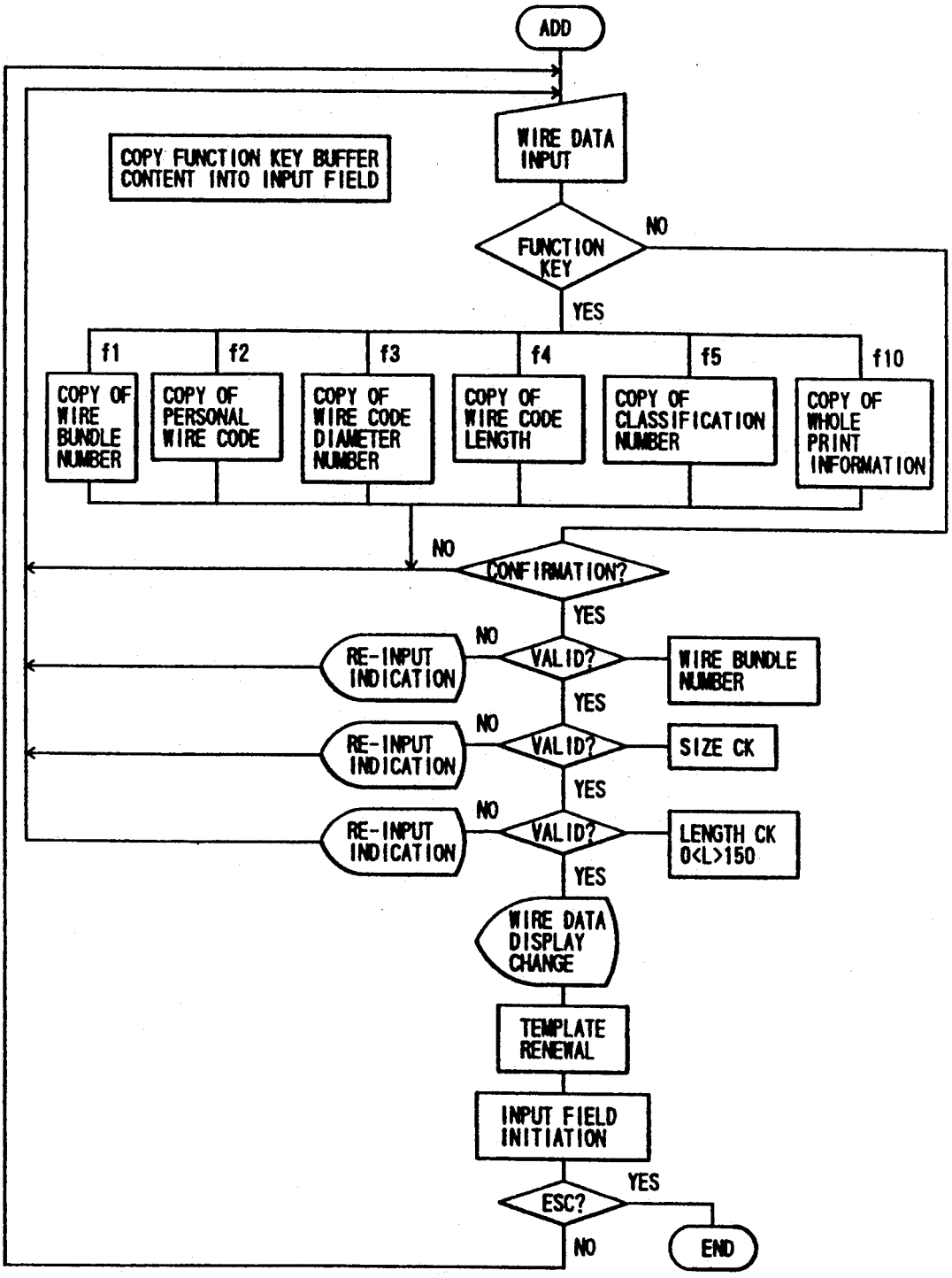
FIG. 19 is a flowchart representing an addition processing.

The addition mode is a mode performing the processing shown in FIG. 19, and is utilized at a time when data is newly inputted or an additional data is further added to the existing data.

That is, the operator inputs the wire data in "WIRE DATA INPUT" processing or inputs either one of the function keys of f1 to f5 and f10. Then, the inputted content is checked as to whether or not the content is the function key.

When the wire data is inputted, wire bundle number, size (thickness) and length are checked in values, and this checking is carried out as to whether or not the checked values are mated with rules preliminarily set with respect to the respective values.

When the function key is inputted, the templates are utilized, and the content of the template corresponding to the function key is copied in an input field. The function f1 copies the wire cord bundle number, and the functions f2, f3, f4, f5 and f10 copy the wire cord personal number, the wire cord diameter number, the length of the wire cord, the classification number and the whole printing information, respectively. Upon the completion of such copying, the wire data is inputted.

The checking operation of the wire data will be explained hereunder.

For example, data for carrying out the printing on electric wire cords for an aircraft is displayed as □W1234□-□AB5678□-□-24□□□□-□10□-□□01□□□ with a format of □ wire bundle number □-□ personal wire number □-□ wire diameter number □-□ length □-□ classification number , in which mark □ represents a blanked mark (space).

The letter W after the first blanked letter is identified as starting of the printing information, and the succeeding number within four columns is identified as the wire cord bundle number. Accordingly, numbers of less than four columns or over the four columns will be considered to be invalid.

The succeeding group of six letters represent the personal number. For example, letter groups of less than and over the six letters are regarded to be invalid.

The further succeeding two columns represent the diameter of the wire cord. The diameter is of AWG size, and kinds to be used are determined. That is, the kinds are 24, 22, 20, 18, 16, 14, 12, 10 . Accordingly, numerals other than these values are regarded to be invalid.

The length is represented by a numerical value of a maximum of three columns. The maximum value is determined to be 150 feet, and greater values are made invalid.

In the case of invalidity, a re-inputting instruction is displayed on the display screen. At this time, an acoustic noise or flush may be generated as the occasion demands to inform the operator of this fact.

In the case of all being made valid, the display of the data of the input field is transferred to the "DATA ADDITION (SELECT ME)" column, and the content of the template is made the present content in the input field.

Figure 23:
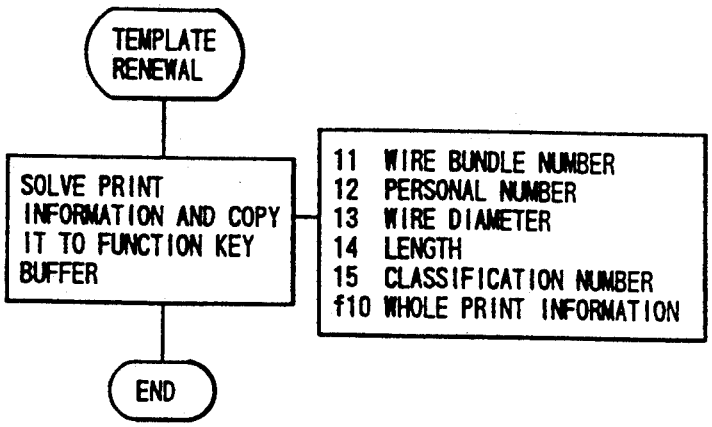
FIG. 23 is a flowchart representing a template processing.

This processing is so performed, as shown in FIG. 23, that the printing information is factorized into elements corresponding to the function keys of f1 to f5, and the contents of the respective elements in the present input field are set to the corresponding registers.

After the renewal of this template, the input field is initiated, thus completing one addition processing.

Figure 20:
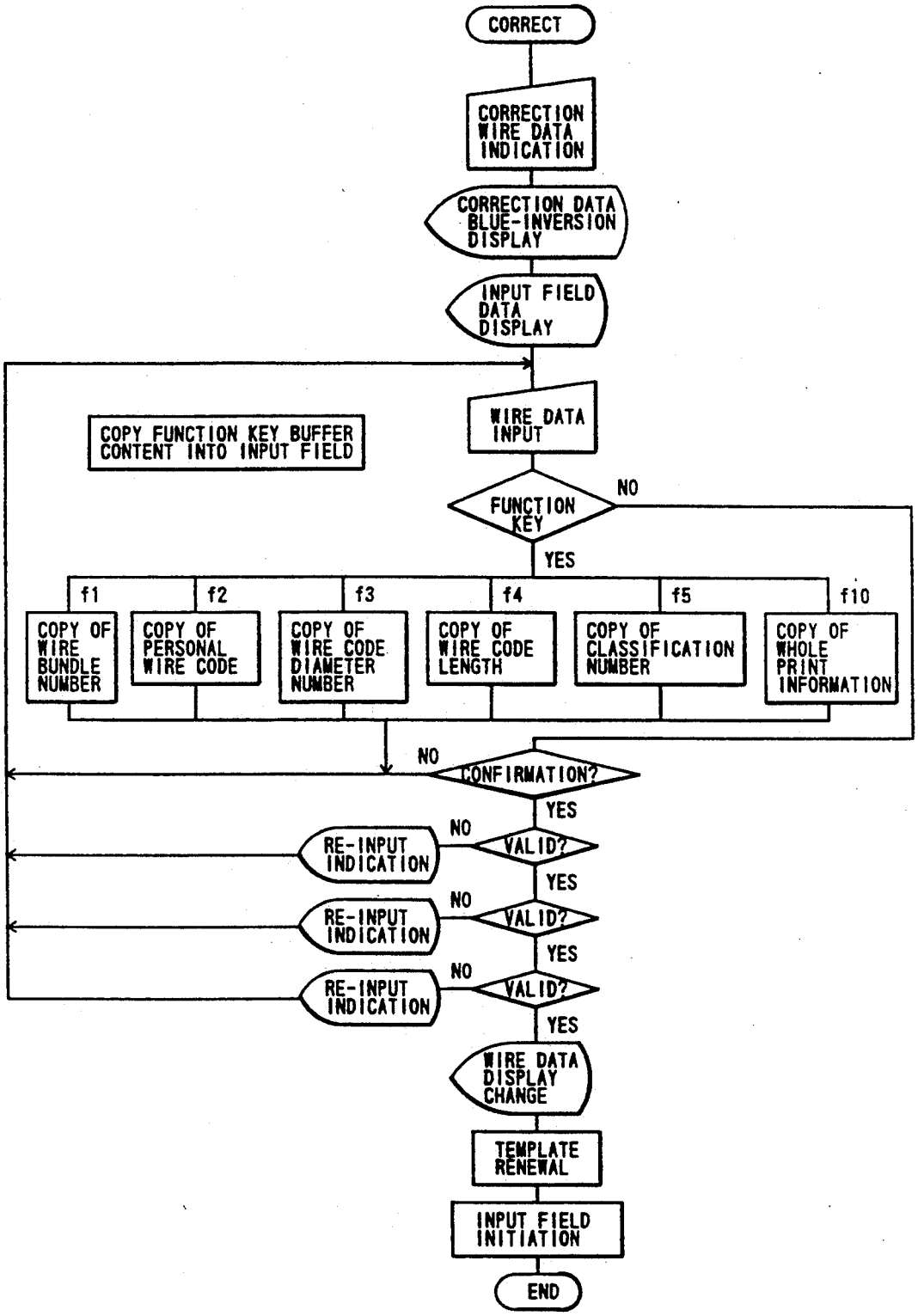
FIG. 20 is a flowchart representing a correction processing.

The correction mode is a mode executing the processing shown in FIG. 20 and this correction is executed with respect to already existing data. In this case, the cursor is moved so as to accord with the column of the data to be corrected in the data display columns and the return key is then depressed, thus designating the subject of the data to be corrected. The data is then invertedly changed in color into blue and transferred to the input field. Under this state, inputting processing will be carried out by utilizing the template and the input field as described in the case of wire data addition.

When the inputted data is considered to be valid, the blue color display is changed with one in the input field, the template is renewed and the input field is initiated.

Figure 21:
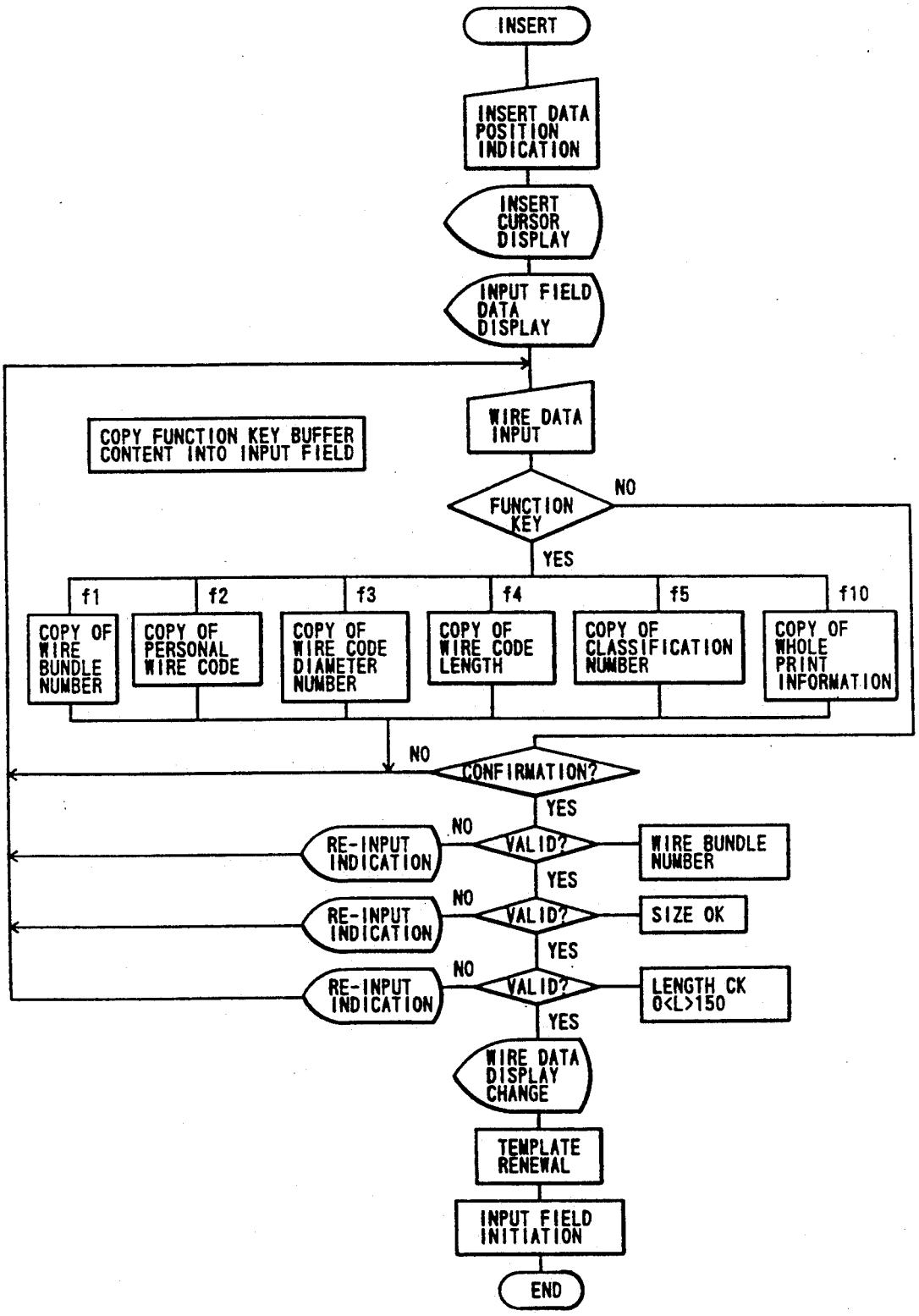
FIG. 21 is a flowchart representing an insertion processing.

The insertion mode is a mode carrying out a processing as shown in FIG. 21. Another data is further inserted before a certain data with respect to the already existing data. In this case, the cursor is first moved so as to accord with a column into which a data line is to be inserted, and the return key is then depressed, a portion to be inserted thus being designated. Then, in the input field, the data of the column with which the cursor accords is displayed, and the data is inputted into the input field by using or not using the template.

When the inputted data is made valid, the input data is inserted into the column designated as a portion to be inserted and the succeeding data is rearwardly shifted. Then, the template is changed and the input field is initiated, thus completing one insertion processing.

Figure 22:
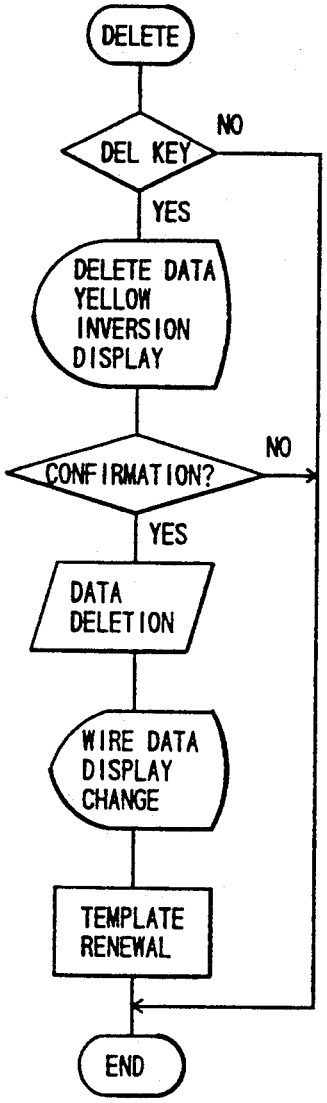
FIG. 22 is a flowchart representing a removing processing.

The deletion mode is a mode executing the processing shown in FIG. 22 to carry out deletion of the data.

In this mode, the cursor is moved so as to accord with a portion of data to be deleted and a deletion key is depressed, thereby the column to be deleted is invertedly changed into yellow color. Upon an identification inputting, thereafter, the data is deleted, the display of the wire data is changed, and the template is renewed.

The index mode is a mode enabling the data in the RAM area to be indexable by expressing the wire number and the size with keys. This processing is represented by FIG. 24.

Figure 24:
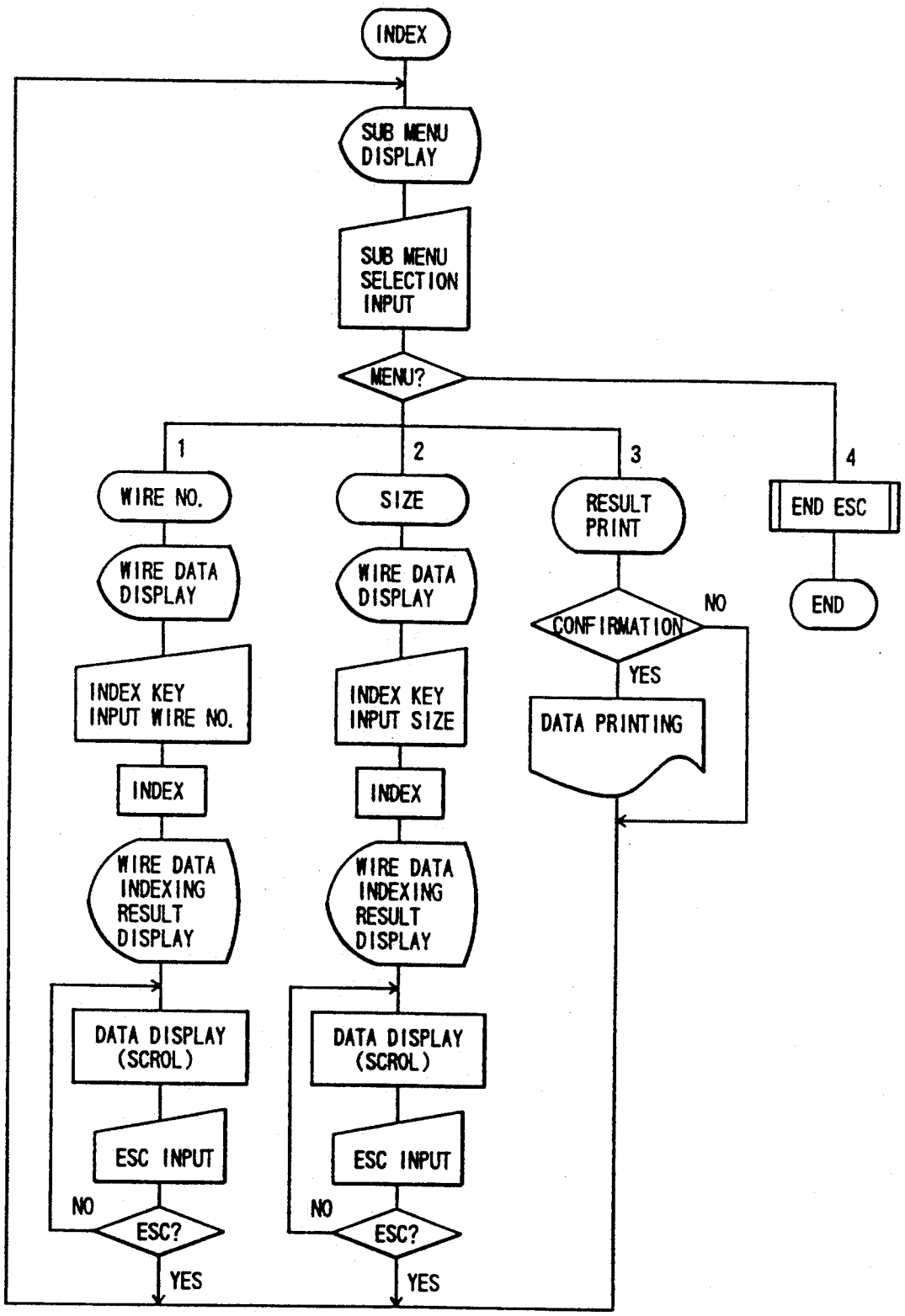
FIG. 24 is a flowchart of an indexing processing for a data processing mode.

Referring to FIG. 24, the menus regarding the index key and index result printing processings are displayed as sub-menus. The operator, at this time, selects either one of them and the processing is branched in accordance with this selection by the operator.

For example, when the WIRE NUMBER (WIRE NO.) is selected, the wire data is first displayed, and when the wire number is inputted thereafter as the index key, the data including this wire number is indexed and then displayed in the data display area. The operator can identify this indexing result entirely by scrolling the display screen.

Substantially identical processings are referred to with respect to the SIZE (SIZE) .

Figure 25:
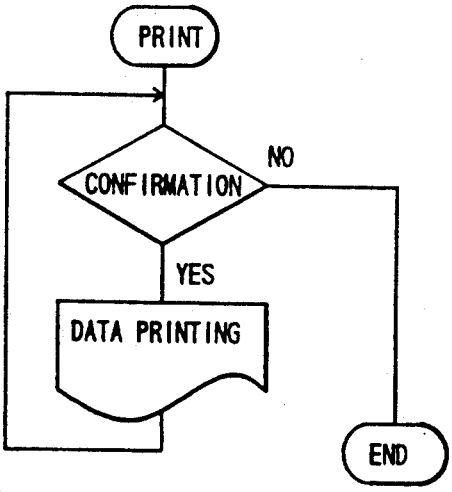
FIG. 25 is a flowchart representing a printing processing.

When the INDEX RESULT PRINTING is selected, the data indexed in response to the identification input is printed. The printing mode is executed by printing the chart of the data inputted by the execution of the input mode and the index mode by utilizing the printer 86, and processings shown in FIG. 25 are executed.

The printing mode (PRINTING) includes the automatic printing mode (AUTO), the semi-automatic printing mode (SEMI AUTO), the set-up mode (SET UP), and the wire insertion mode (WIRE INS). The operations described above with respect to the mechanisms are based on the execution of this printing mode.

Figure 26:
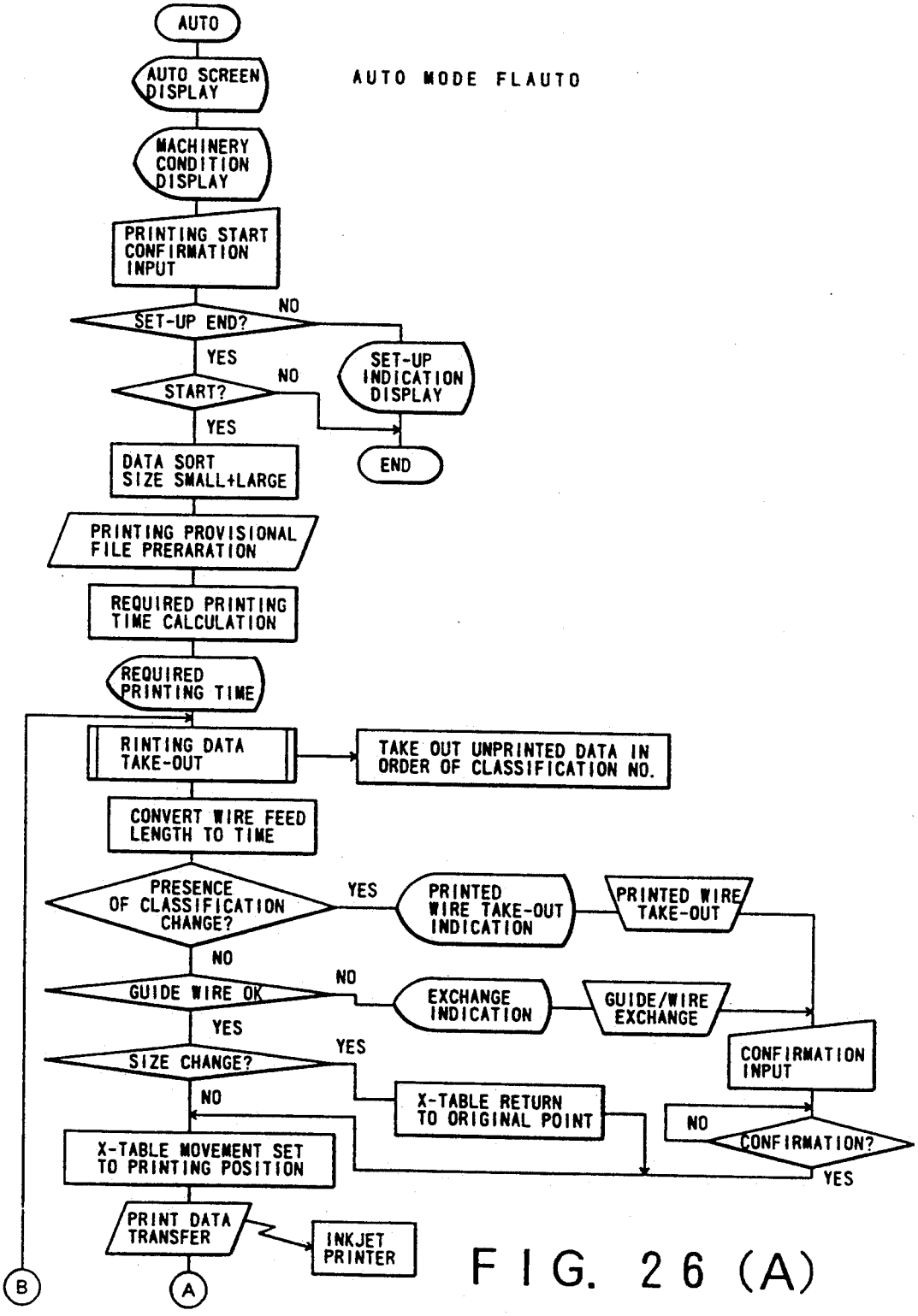
FIGS. 26A and 26B are flowcharts representing automatic printing modes of wire cord printing modes.
Figure 26:
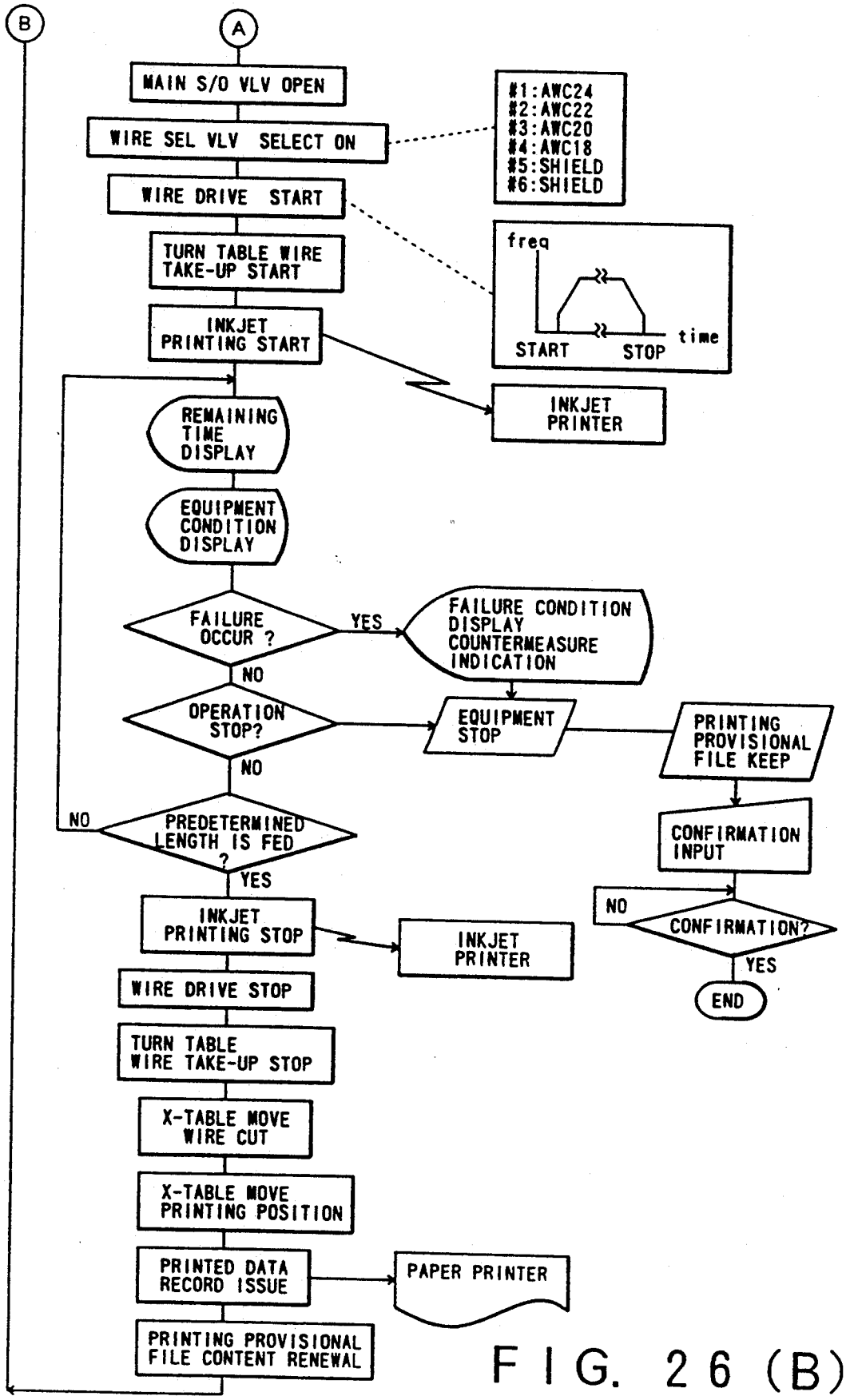

The automatic printing mode is a mode in which all the data in the file designated are taken out in order and then printed successively, and the processing represented by FIG. 26 will be executed.

That is, the automatic printing mode is displayed on the display screen, which is approximately shown in FIG. 36.

In the column of "AUTO", input menus such as stop (ESP) and termination (F. 1) are displayed. In the column of "CONDITION OF EQUIPMENT", the present conditions of elements or equipment items constituting the mechanism are displayed. In the column of "REMAINDER TIME", the remaining time for the completion of the printing is displayed. In the column of "REQUIRED TIME", the time required for the whole printing operation is displayed. In the column of "COA NO.", a working name is displayed. In the column of "WIRE NO.", the wire data now in printing is displayed. In the column of "MESSAGE AREA", various messages are displayed.

After the completion of the screen display, the present conditions of the elements or equipment, i.e. "IN SET UP" or "SET UP COMPLETION", are displayed in the column of "CONDITION OF EQUIPMENT".

In the next step, when the printing operation is started by the instructions of the operator, it is discriminated whether all the equipment items are made to set up or not. In the case of not set up, the instruction of "MAKE SET UP" is issued in the "MESSAGE AREA" column on the display screen.

In the case of the completion of the set-up, reconfirmation for the starting of the printing is made, and the data which have already been read is sorted from data having a small size, the result being prepared as a printing provisional file.

In the next process, the time required for the printing is calculated and the calculated result is displayed in the "REQUIRED TIME" column. The time T0 required in this process is the time required for the total steps obtained from the following equation in accordance with the total length of the wire cord to be printed on the basis of the printing information in the file, the numbers of the wire cords, the numbers to be changed in diameters of the wire cords, and the classification numbers thereof.

$$T0 = T1 + T2 + T3$$

T1: time required for printing=(total length of wire cord×(feed speed (0.6 m/s)), T2: total cutting time=(number)×(time for cutting one wire cord), T3: number of times the diameter of the wire cord is changed.

The change of diameter is performed after once returning to the original point for the improvement of the positioning accuracy, and accordingly, the moving time therefor is added.

Figure 27:
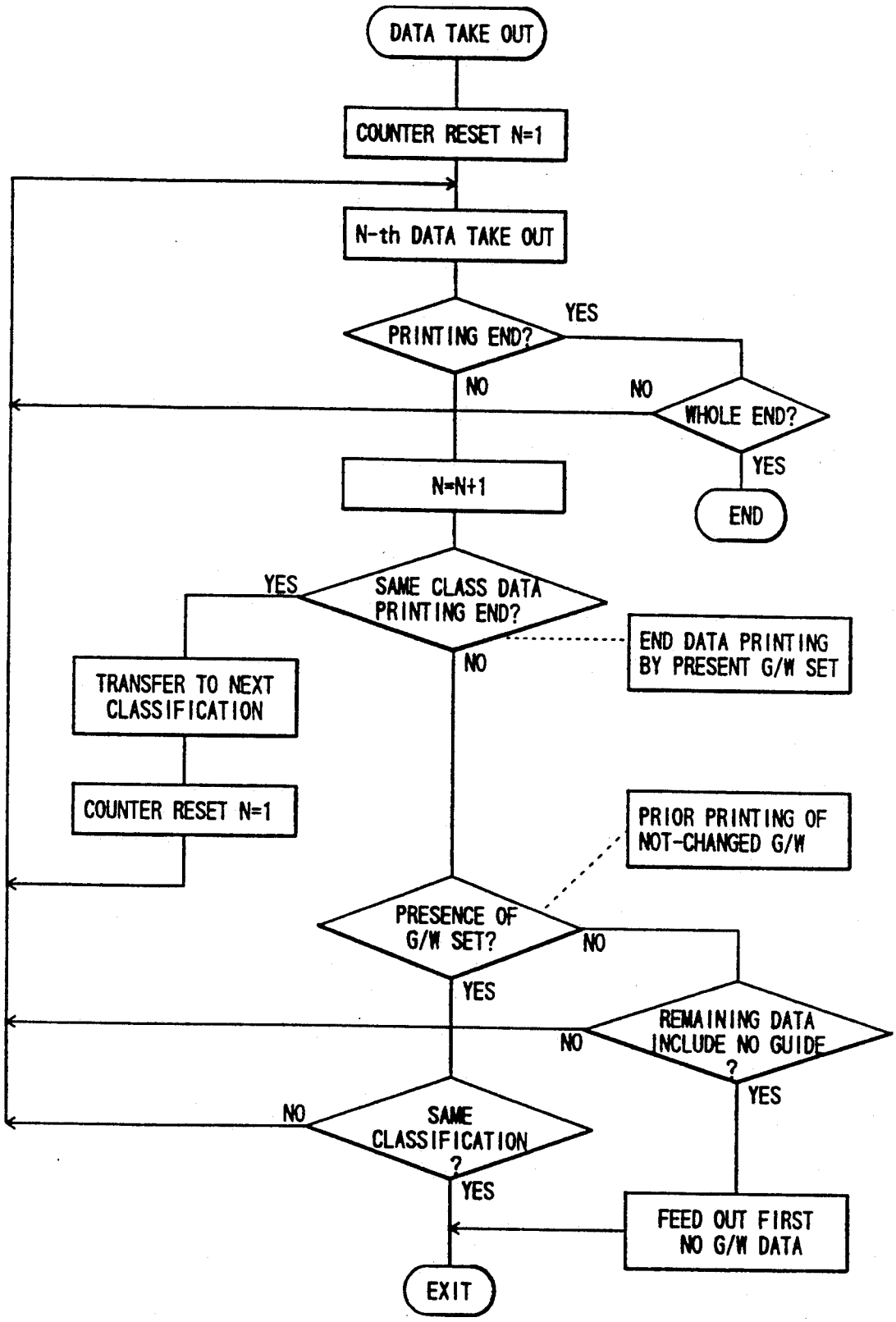
FIG. 27 is a flowchart representing data take-out processing of FIG. 26.

The printing starts from the step of PRINTING DATA TAKE-OUT , which is composed of the processing represented by FIG. 27.

The counter N is first reset as "N=1". The N-th data, i.e., leading data of data sorted first initially, is taken out and it is discriminated that this data has been subjected to the printing or not by the step of "WHETHER OR NOT PRINTING IS COMPLETED?".

In case of no completion of printing, the counter N is changed newly to "N=N+1". Then, it is checked whether data in the same class as that of the former data has been entirely printed. That is, when the data of the same class is present, the data of same class are together classified and printed.

When the data of the same class is present, it is checked whether or not the set of guide/wire cord of the present wire data is loaded. This checking aims to improve the working efficiency by printing together the same guide/wire cord of the wire data to thereby reduce the frequency of the exchanging working for the guide/wire cord.

When the set of guide/wire cord is loaded, it is checked whether or not the present data is of the same class as that of the former data, and if it is of the same class, this printing data take-out processing is omitted.

In the processing of "WHETHER PRINTING IS COMPLETED ?", in the case of completion of the printing of the present data, it is checked whether or not all of the printing has been completed. In case of completion, the mode is ended (that is, the automatic printing mode has been completed).

In the step of COMPLETELY ENDED? , when any remaining data exists, the next data will be taken out.

In the step of WHETHER THE SAME CLASS DATA IS PRINTED?, in the case of the completion of total printing of the same class, the printing step advances to the next class, and the counter N is reset, the N-th data being taken out.

In the step of IS PRESENT G/W SET ? , in the case of no loading of the guide/wire cord set, it is checked whether or not data capable of being printed by the presently loaded set exists in the remaining data, and in the case of existence, the next data will be taken out. In the absence of the data capable of being printed by the presently loaded set, data of no guide/wire cord is transferred.

In the step of SAME CLASS? , when the present data is not of the same class as that of the former data, the next N-th data will be taken out.

Then, back to FIG. 26, the wire cord feeding length is first converted into time. That is, the wire cord driving motor is of a stepping motor type in which the rotational speed accurately corresponds to time, and accordingly, the feeding of the wire cord by the predetermined amount is controlled in response to the time.

Next, in the step of PRINTING DATA TAKE OUT , it is checked whether or not the discrimination of the presence of the classification change is made, and in the presence of this discrimination, the display for instructing the take-out of the printed wire cord is displayed in the "MESSAGE AREA" on the display screen. At this time, the operator removes the case 41 and exchanges it with another empty one 41. Upon confirmation of the completion of this work, the processing advances.

In the step of GUIDE WORK OK? , it is checked whether or not the guide/wire cord should be presently maintained as it is in accordance with the checking of whether or not a signal of no guide/wire cord is transmitted. In case of the exchanging, a display for instructing the exchange is made in the "MESSAGE AREA" column of the display screen. In this case, the operator exchanges the reels 8 and the reels 14, and as described before, one set of exchangeable two sets is exchanged. Upon confirmation of the completion of the exchanging work of the operator, the step progresses to the next step.

In the step of SIZE CHANGE , the positioning table 29 on which the printing head 30 of the printing unit is mounted is returned to the preliminarily set original position, and then the step advances. When the described checkings have been completed, the positioning table 29 is first moved by a predetermined displacement to a setting position of the wire cord to be printed.

Then, the printing data is transferred to the printing device 45. The main air valve is next opened, and the valve of the air cylinder 24 corresponding to the wire cord to be printed is then opened to thereby interpose the wire cord between the rollers 17 and 18. In FIG. 26B, the symbols #1 to #4 represent the positions at which the sizes of the wire cords are fixed, and the symbols #4 and #5 represent the positions at which the sizes of the wire cords can be exchanged.

Subsequently, the wire cord driving motor 20 is operated, and the wire cord take-up motor 44 is also driven to thereby indicate the starting of the printing operation.

During the printing operation, as shown in FIG. 36, in the steps of the REMAINING TIME DISPLAY and EQUIPMENT CONDITION DISPLAY , the predetermined displaying is made, and in the step of FAILURE OCCURS ? , it is checked whether any failure has occurred or not. In the step of OPERATION STOPS? , it is checked whether or not the process stopping operation exists, and in the step of WIRE CORD IS FED BY PREDETERMINED LENGTH ? , it is checked whether or not the wire cord is printed by the length displayed by the data.

When the printing of the wire cord by the predetermined length has been completed, an indication signal representing the completion of the printing is transmitted to the printing device 45, whereupon the wire cord driving motor 20 and the wire cord take-up motor 44 are stopped. The positioning table 29 is moved so as to cross the printing positions to thereby cut the wire cord 4 with the cutter 31 secured to the front end of the positioning table 29. After the operation, the positioning table 29 is moved reversely to return to its original printing position.

Then, the printer 86 is operated to print out the printed data.

Thereafter, a provisional file for printing including information of printed data or the like is renewed, and then the step returns to the PRINTING DATA TAKE-OUT .

As described above, as long as a process does not stop in an emergency, the process from the PRINTING DATA TAKE-OUT to the RENEWAL OF PROVISIONAL FILE CONTENT FOR PRINTING is repeated with respect to one data.

Figure 44:
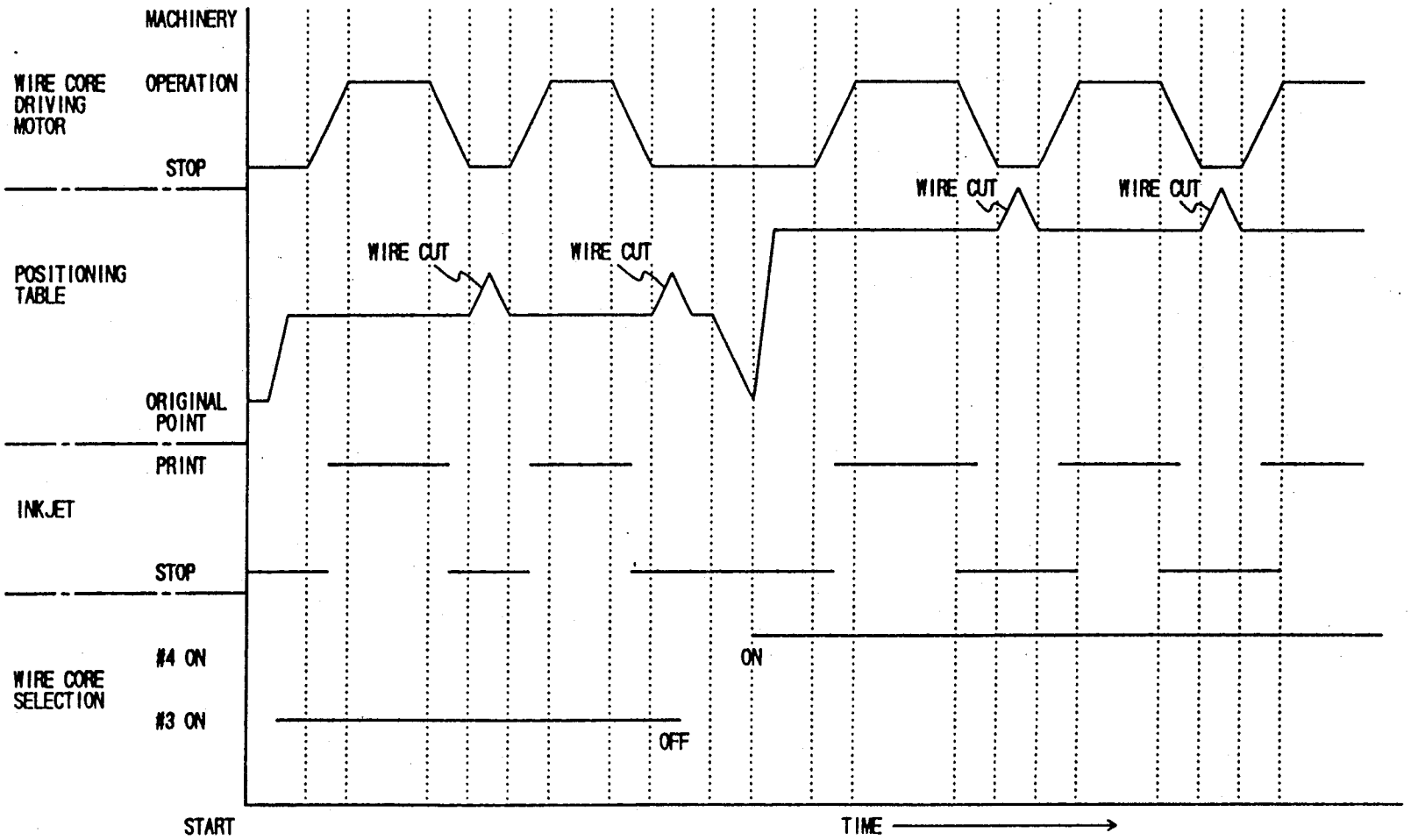
FIG. 44 is a time chart showing printing timings of respective mechanisms in accordance with the automatic or semi-automatic printing mode.

As the result of this controlling, the operation mode will be as shown in FIG. 44, which represents a case in which the wire cords #3 and #4 are selected with respect to two data.

When the printing operation has been completed for all data, it is discriminated that the entire printing operation has been ended in the processing of the WHOLE OPERATION IS ENDED? in the step of the PRINTING DATA TAKE-OUT . Thus the automatic printing mode has been completed.

Further, in the process of the FAILURE OCCURS? , when the occurrence of the failure is confirmed, the condition of the failure and the countermeasure therefor are displayed on the display screen, and the operations of the equipment are stopped. The operator remedies the failure in accordance with the instructions displayed on the screen surface.

In such an occurrence of failure, displays are made as shown in FIGS. 37 to 40 in accordance with the causes of the failure.

In the step of the OPERATION STOP? , when the operation-stop is confirmed, an image such as that shown in FIG. 41 is displayed, and the operation of the equipment stops. The operator carries out measures to remedy the failure.

The displays shown in FIGS. 37 to 40 are made on the image screen at the time of failure in accordance with the causes thereof.

When the operation stop is confirmed in the processing of the OPERATION STOP? , an image such as that shown in FIG. 41 is displayed, and the operation of the equipment stops.

When the operation of the equipment stops due to occurrence of failure or an emergency stop, the printing provisional file is stored at that time, and the automatic printing mode is ended after the confirmation input.

According to this automatic printing mode, the automatic printing work and the classification work are completed for each file, i.e., for each work.

In the step of PRINTED DATA RECORD ISSUE , when the printing relating to one classification has been completed, such printing as "--- cut from this line . . . ---" is carried out as shown in FIG. 45. The operator cuts off the wire cord along this line, and the cut cord is accommodated in a bag together with a wire cord of the corresponding classification.

According to this automatic printing mode, the printing speed becomes high because the take-out of the data is controlled so that the number of exchanging times is reduced as much as possible.

More specifically, 4 minutes and 30 seconds were spent for the printing, cutting and taking up operations for all 24 wire cords under the following conditions.

Wire cord feeding speed: 60 cm/sec.

Number of wire cords of different diameters: 3

Selection and change of wire cords of different diameters: 3 times

Length:

10 m 5 lengths
6 m 5"
4 m 10"
20 m 4"

Total length: 200 m

Cutting times: 24 times

The semi-automatic printing mode (SEMI AUTO) is different from the above automatic printing mode in the data take-out method. That is, as described above, in the automatic printing mode, all of the data of the designated file are taken out in the predetermined order, but in the semi-automatic printing mode, data to be printed are selected one-by-one by a hand inputting operation or directly inputting operation for the case of printing data not existing in the file in an interruption mode, and the processing shown in FIG. 28 is performed.

Figure 28:
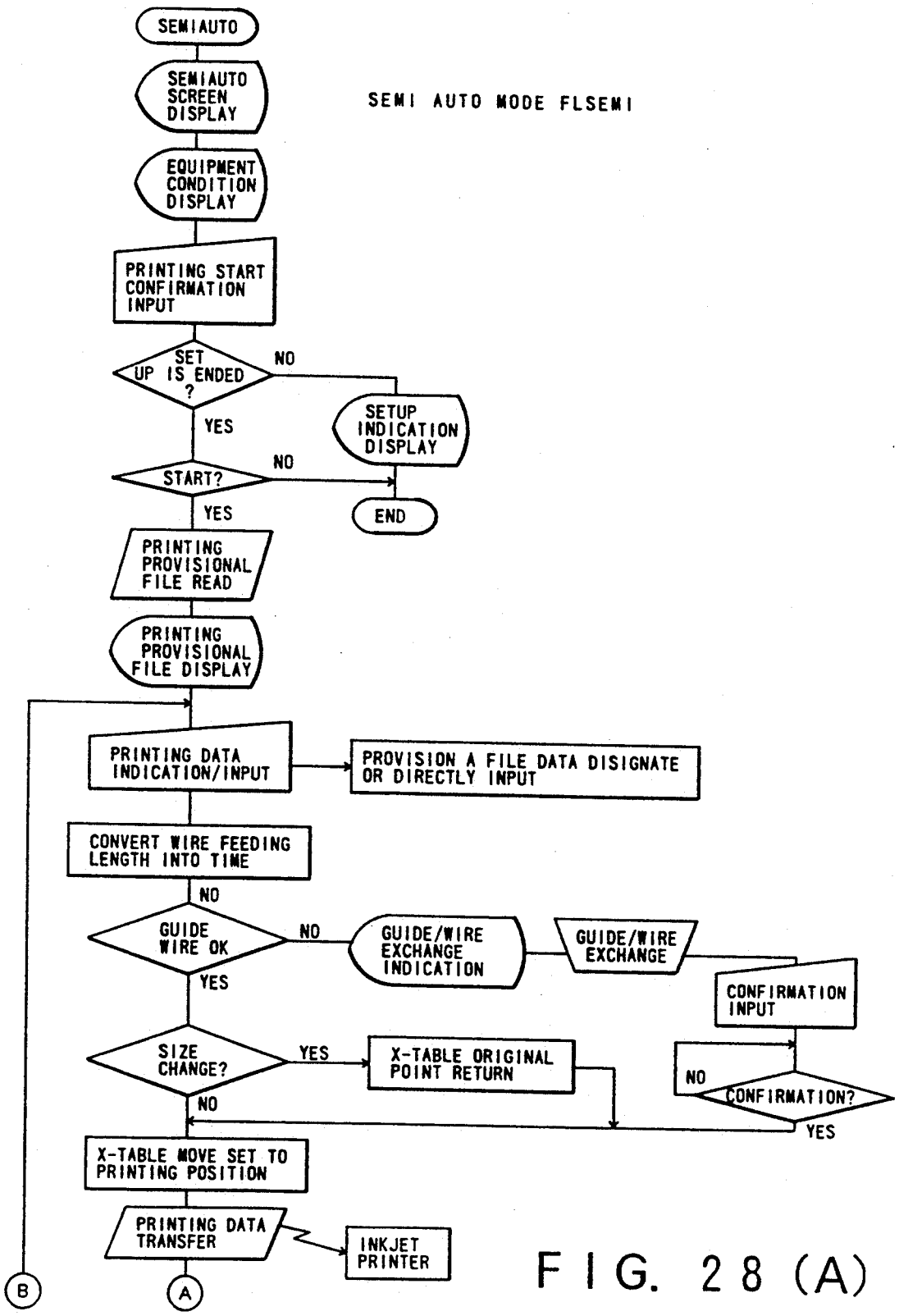
FIGS. 28A and 28B are flowcharts representing semi-automatic printing modes.
Figure 28:
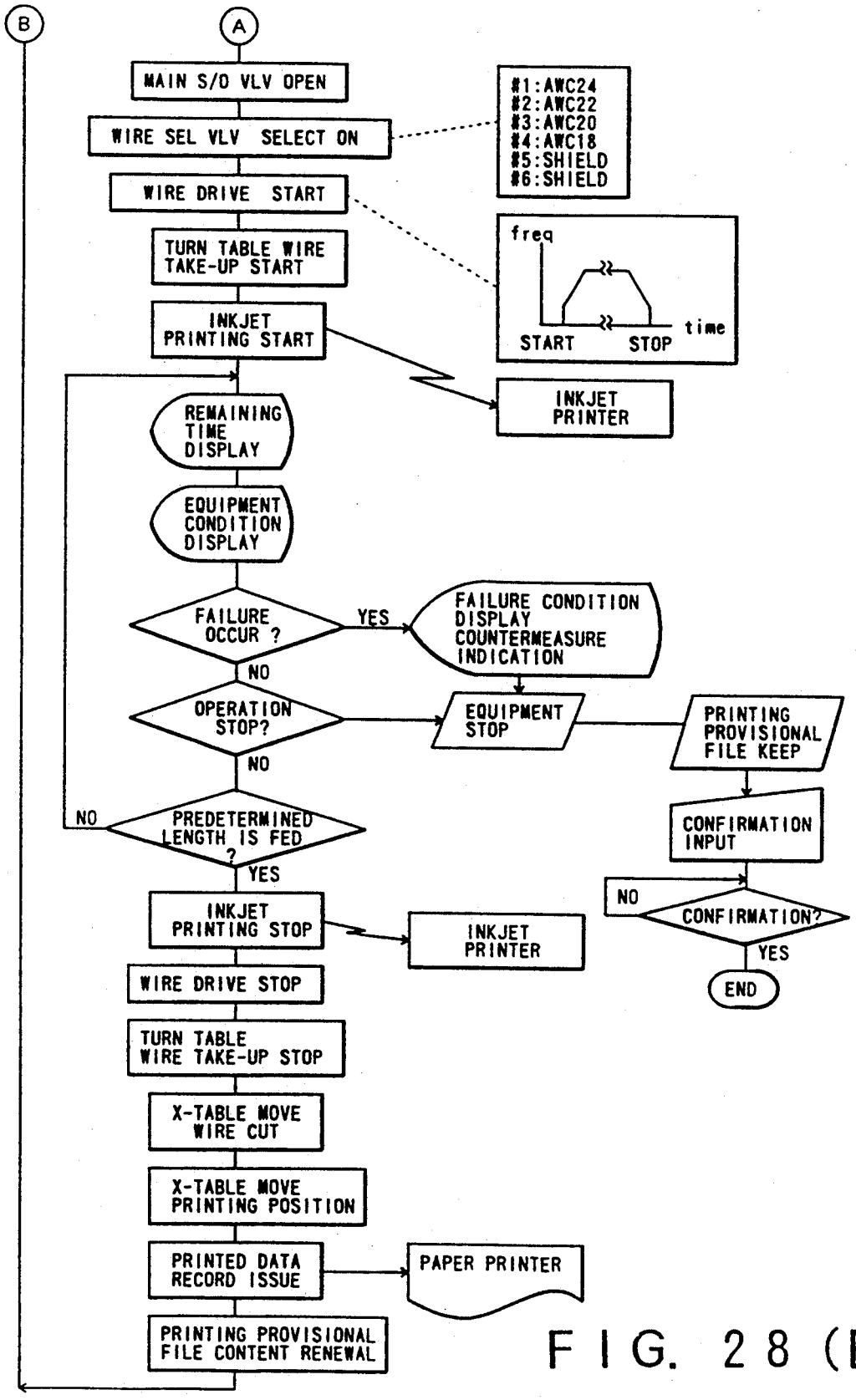

Referring to FIG. 28, the image surface of the semi-automatic printing mode is first displayed. In this image screen of the semi-automatic printing mode, the form is like a mode in which an input area is added to the image surface of the automatic printing mode.

The steps from the EQUIPMENT CONDITION DISPLAY to the START? are substantially the same as those of the automatic printing mode.

Next, the printing provisional file is read and displayed.

Then, data to be printed from the displayed data is selected and inputted or directly inputted by utilizing the input area.

Thereafter, like the automatic printing mode, the processing for converting the feeding length of the wire cord into time is carried out.

In the automatic printing mode, a step for confirming the presence or absence of the classification change is incorporated, but in the semi-automatic printing mode, such a step is not included, and only the processing of the confirmation of GUIDE/WIRE OK? and SIZE CHANGE? is performed.

Thereafter, processing after the step of X-TABLE MOVE PRINTING POSITION SET is the same as that of the automatic printing mode.

An interruption printing can be performed by the semi-automatic printing mode.

The set-up mode (SET UP) is a mode for performing the set-up of the mechanism, and when the operator utilizes the system, the set-up mode is first executed.

FIG. 42 is a screen display formed by the step of SET UP INDICATION DISPLAY of the automatic/semi-automatic printing mode, and when this screen is displayed, this set-up mode is executed.

During the execution of this set-up mode, an image screen such as that shown in FIG. 43 is displayed.

Accordingly, the respective items of equipment are warmed up into stand-by states.

The wire cord loading mode is a mode utilized for the loading of the wire cord into the machine.

The maintenance mode (MAINTENANCE) is a mode carrying out the operation test for the mechanisms, and "X-TABLE" is a positioning table as the movable printing unit. "STEP MOTOR" is a stepping motor as the wire cord feeding unit.

"SOL VLV" is an air-pressure valve for actuating the air cylinder of the selecting and driving unit; "INK JET" is the printing unit; "TURN TABLE" is a recovery unit for the printed wire cord; and "R/0 PRINTER" is a printer for printing out the classification sheets.

As described above, according to the present invention, a desired plurality of wire cords to be set in the wire cord storing unit are fed by means of the selecting and driving unit, and the thus fed wire cords are printed with the schema identification displays by the movable printing unit on the way of the feeding path of the wire cords. Accordingly, it is not necessary to print every wire cord as in the prior art, and the printing work can be carried out according to the desired kinds of the wire cords, thus being suitable with improved efficiency for the requirement of the printing work of many kinds and small amount of the wire cords.

Furthermore, by utilizing the printing head of the ink-jet system as the printing means, clear printing can be accomplished on even twisted wire cords. Moreover, by locating the cutter so as to face the movable printing unit, the wire cord can be cut by the utilization of the displacement of the printing head, so that the provision of an independent cutting device can be eliminated. Thus the structure of the system and apparatus can be made simple and compact.

Furthermore, the printing operation can be performed together with the classification. The classification work after the printing operation, which is carried out in the prior art technique, can be eliminated.

Since the time required for the printing is calculated and displayed, the work plan can be easily determined, whereby it is possible to preliminarily know the work end time.

Furthermore, in the case of inputting the data to be used as the printing data, such input data is checked, so that the error can be corrected at the inputting time, and accordingly, the loss of the wire cord and the loss of time due to the printing of the erroneous data can be obviated.

Furthermore, in the case of this data inputting, since the data inputted just before it is copied in the data holding means, and the data can be inputted by partially changing the same, a plurality of identification displays with less change of the print content can be easily made with no error.

Still furthermore, since it is possible to extract the constructional element of the wire cord data from the existing data and convert it into a writing type of the wire cord to be printed and there is provided means for writing this into the wire cord data storing unit, the existing data can be processed as the wire cord data and utilized as the printing data.

We claim:

1. A printing apparatus for wire materials in which identification displays for a wire material are printed on an outer periphery of the wire materials, comprising:

selection and drive means for feeding laterally spaced wire materials in a longitudinal direction and for selecting a laterally spaced wire material to be printed upon, the laterally spaced wire materials being laterally spaced at an exit location of said selection and drive means for a first transverse distance;

printing means for printing an identification display upon the selected laterally spaced wire material, said printing means further including a printing head assembly, a positioning table for supporting said printing head assembly and means for moving said printing head assembly with respect to said positioning table such that said printing head assembly is adapted for lateral movement for the first transverse distance;

a cutter member supported by said printing head assembly such that said cutter member is adapted t move transversely with said printing head assembly through the selected laterally spaced wire material so as to cut the selected laterally spaced wire material; and drive control means for controlling the selection and drive means and the movable printing means so that printing is carried out on a wire material designated by printing data, a wire data storing means for storing a plurality of data of a wire material to be printed including contents of identification displays and class identification marks of the wire materials, and a data take-out means for taking out the data from the data storing means one-by-one so that the wire materials having the same class identification marks are continuously taken out and transmitting said take-out data to the drive control means as printing data.

2. An apparatus as recited in claim 1 wherein said printing head assembly includes an ink-jet-type printing head and a supporting pedestal.

3. A printing apparatus for wire materials in which identification indicia for a wire material is applied to an outer periphery of the wire material, comprising:

a selection and driving unit which includes a plurality of laterally spaced driving rollers which are laterally spaced apart for a first transverse distance, said selection and driving unit further including a plurality of pinch rollers and means for placing said pinch rollers in engagement with respective driving rollers;

a plurality of laterally spaced guide members for longitudinally directing a plurality of wire materials downstream from a variety of different wire material sources to said selection and driving unit;

control means for selectively activating said means for placing said pinch rollers in engagement with said driving rollers such that a selected one of the wire materials is further moved downstream with respect to said selection and driving unit;

a printing assembly which includes a printing head assembly, a support platform and adjustment means for transversely adjusting said printing head assembly such that said printing head assembly is adapted for movement across said first transverse distance, said control means further comprising means for activating said adjustment means such that said printing head assembly is positioned in a first selected position over the selected one of the wire materials;

a cutting member supported by said printing head assembly so as to be transverse moveable with said printing head assembly, said cutting member being dimensioned and arranged such that said cutting member is adapted to pass transversely through and cut the selected one of the wire materials upon said adjustment means transversely moving said printing head assembly to a second selected position.

4. A printing apparatus as recited in claim 3 further comprising a trough member positioned downstream from said printing head and which includes guides for directing any one of the laterally spaced wire materials to a common outlet positioned at a downstream end of said trough member.

5. A printing apparatus as recited in claim 3 wherein said printing head assembly includes an ink-jet-type printer head and a supporting pedestal, and said cutting member being laterally offset with respect to said selected one of the wire materials when said printing head is in position over said selected one of the wire materials.

6. A printing apparatus for wire materials in which identification indicia for a wire material is printed on an outer periphery of the wire material, comprising:

selection and driving means for feeding laterally spaced wire materials in a longitudinal direction and for selecting a laterally spaced wire material to be printed upon, the laterally spaced wire materials being laterally spaced at an exit location of said selection and drive means for a first transverse distance;

cutting means for cutting the wire materials;

printing means for printing identification indicia upon the selected one of said laterally spaced wire materials, said printing means further including a printing head assembly, a positioning table for supporting said printing head assembly and means for moving said printing head assembly with respect to said positioning table such that said printing head assembly is adapted for lateral movement for the first transverse distance and positionable into a printing operation position with respect to the selected one of said laterally spaced wire materials; and drive control means for coordinating positioning of said printing head assembly and the driving of selected wire materials, said drive control means including:

(a) means for inputting data concerning a set of wire materials which require individual identifying indicia, (b) means for calculating a time period required for completion of a predetermined printing sequence for the wire materials in said set of wire materials which is based on a formula $To=T_1+T_2+T_3$ with To representing the calculated time period, $T_1$ representing a multiplication of a total length of wire material to be fed times a wire material feed speed of said selection and drive means, $T_2$ representing total cutting time equal to a number of cuts times a time for cutting the wire materials, and $T_3$ representing a number of times wire cord diameter of the wire material changes during the printing sequence, and (c) means for displaying the calculated time To.

7. A printing apparatus as recited in claim 6 further comprising a cutting member fixed to said printing head assembly.

8. A printing apparatus as recited in claim 6 further comprising a trough member positioned downstream from said printing head assembly and having a plurality of guides for directing wire material to a single downstream positioned outlet.

9. A printing apparatus for wire materials in which identification indicia for a wire material is applied to an outer periphery of the wire material, comprising:

a selection and driving unit which includes a plurality of laterally spaced driving rollers which are laterally spaced apart for a first transverse distance, said selection and driving unit further including a plurality of pinch rollers and means for placing said pinch rollers in engagement with respective driving rollers;

a plurality of laterally spaced guide members for longitudinally directing a plurality of wire materials downstream from a variety of different wire material sources to said selection and driving unit;

control means for selectively activating said means for placing said pinch rollers in engagement with said driving rollers such that a selected one of the wire materials is further moved downstream with respect to said selection and driving unit;

a printing assembly which includes a printing head assembly, a support platform and adjustment means for transversely adjusting said printing head assembly such that said printing head assembly is adapted for movement across said first transverse distance, said control means further comprising means for activating said adjustment means for positioning said printing head assembly in a printing operation position and means for activating said selection and driving unit such that only the selected wire material is positioned downstream of the printing head assembly when printing at the printing operation position and all remaining wire materials being retained upstream of said printing head assembly and in engagement with said selection and driving unit.

10. A printing apparatus as recited in claim 9 further comprising a cutting member fixed to said printing head assembly.

11. A printing apparatus as recited in claim 9 further comprising a trough member positioned downstream from said printing head assembly and having a plurality of guides for directing wire material to a single downstream positioned outlet.

12. A printing apparatus for wire materials in which identification displays for a wire material are printed on an outer periphery of the wire materials, comprising:

selection and drive means for feeding laterally spaced wire materials in a longitudinal direction and for selecting a laterally spaced wire material to be printed upon, the laterally spaced wire materials being laterally spaced at an exit location of said selection and drive means for a first transverse distance;

printing means for printing an identification display upon the selected laterally spaced wire material, said printing means further including a printing head assembly, a positioning table for supporting said printing head assembly and means for moving said printing head assembly with respect to said positioning table such that said printing head assembly is adapted for lateral movement for the first transverse distance;

a cutter member supported by said printing head assembly such that said cutter member is adapted to move transversely with said printing head assembly through the selected laterally spaced wire material so as to cut the selected laterally spaced wire material; and drive control means for controlling the selection and drive means and the movable printing means so that printing is carried out on a wire material designated by printing data, a wire data storing means for storing a plurality of data of a wire material to be printed including contents of identification displays and class identification marks of the wire materials, a data take-out means for taking out the data from the data storing means one-by-one and transmitting said take-out data to the drive control means as printing data, a time calculation means for calculating times required for printing all data of the plurality of wire materials to be printed, and time display means for displaying a result calculated by the time calculation means.

13. A printing apparatus for wire materials in which identification displays for a wire material are printed on an outer periphery of the wire materials, comprising:

selection and drive means for feeding laterally spaced wire materials in a longitudinal direction and for selecting a laterally spaced wire material to be printed upon, the laterally spaced wire materials being laterally spaced at an exit location of said selection and drive means for a first transverse distance;

printing means for printing an identification display upon the selected laterally spaced wire material, said printing means further including a printing head assembly, a positioning table for supporting said printing head assembly and means for moving said printing head assembly with respect to said positioning table such that said printing head assembly is adapted for lateral movement for the first transverse distance; and a cutter member supported by said printing head assembly such that said cutter member is adapted to move transversely with said printing head assembly through the selected laterally spaced wire material so as to cut the selected laterally spaced wire material; and drive control means for controlling the selection and drive means and the movable printing means so that printing is carried out on a wire material designated by printing data, a wire data storing means for storing data of a wire material to be printed including contents of identification displays and class identification marks of the wire materials, a data take-out means for taking out the data from the data storing means one-by-one and transmitting said take-out data to the drive control means as printing data, a data input means for inputting the wire material data, a stored instruction input means for inputting first stored instructions, an input data holding means for keeping the input data from the data input means, a wire material data write control means for writing the data of the data input means int he wire data storing means in response to second stored instructions, and a data rule discrimination means for discriminating whether or into the data of the input data keeping means conforms with a preliminarily set rule in response to the first stored instructions and, only in case of conformity, transmitting the second stored instructions to the write control means.

14. A wire material printing apparatus according to claim 13, further comprising a stored data holding means, a data copy means for copying the data of the input data holding means into the stored data holding means in response to the second stored instructions, a specific operation requiring input means for inputting a specific operation requirement, and said data copy means being adapted to copy the data of the stored data holding means into the input data holding means in response to the specific operation requirement.

15. A printing apparatus for wire materials in which identification displays for a wire material are printed on an outer periphery of the wire materials, comprising:

selection and drive means for feeding laterally spaced wire materials in a longitudinal direction and for selecting a laterally spaced wire material to be printed upon, the laterally spaced wire materials being laterally spaced at the exit location of said selection and drive means for a first transverse distance;

printing means for printing an identification display upon the selected laterally spaced wire material, said printing means further including a printing head assembly, a positioning table for supporting said printing head assembly and means for moving said printing head assembly with respect to said positioning table such that said printing head assembly is adapted for lateral movement for the first transverse distance;

a cutter member supported by said printing head assembly such that said cutter member is adapted to move transversely with said printing head assembly through the selected laterally spaced wire material so as to cut the selected laterally spaced wire material; and drive control means for controlling the selection and drive means and the movable printing means so that printing is carried out on a wire material designated by printing data, a wire data storing means for storing data of a wire material to be printed including contents of identification displays and class identification marks of the wire materials, a data take-out means for taking out the data from the data storing means one-by-one and transmitting said take-out data to the drive control means as printing data, a data conversion means extracting constructional elements of the data of the wire material to be printed in existing data prepared by a predetermined writing style and converting the extracted data into the data of the wire material to be printed, and data write control means for writing the converted data into the wire data storing means.

16. A printing apparatus for wire materials in which identification displayed for a wire material are printed on an outer periphery of the wire materials, comprising:

selection and drive means for feeding laterally spaced wire materials in a longitudinal direction and for selecting a laterally spaced wire material to be printed upon, the laterally spaced wire materials being laterally spaced at an exit location of said selection and drive means for a first transverse distance;

printing means for printing an identification display upon the selected laterally spaced wire material, said printing means further including a printing head assembly, a positioning table for supporting said printing head assembly and means for moving said printing head assembly with respect to said positioning table such that said printing head assembly is adapted for lateral movement for the first transverse distance;

a cutter member supported by said printing head assembly such that said cutter member is adapted to move transversely with said printing head assembly through the selected laterally spaced wire material so as to cut the selected laterally spaced wire material; and said selection and drive means comprising laterally spaced driving rollers disposed so as to correspond to respective stored wire materials and pinch rollers located in an opposing relationship with respect to said driving rollers, and means for positioning said pinch rollers in a driving position and a non-driving position wherein, when a selected pinch roller is placed in a driving position, a selected one of said laterally spaced wire materials is driven longitudinally downstream.

17. A wire material printing apparatus according to claim 16, wherein said selection and drive means includes a driving motor and a length of the wire material to be fed is measured by measuring means based upon inputs provided by said driving motor and an outer peripheral length of a respective one of said driving rollers.

18. An apparatus as recited in claim 16 wherein said printing head assembly includes an ink-jet-type printing head and a supporting pedestal.

19. An apparatus as recited in claim 16 further comprising a trough member positioned downstream, in wire material feed direction, from said cutter member, and said trough member including guides to direct the laterally spaced wire materials to one outlet.

* * * * *